US006634431B2

(12) United States Patent
Cook et al.

(10) Patent No.: US 6,634,431 B2
(45) Date of Patent: Oct. 21, 2003

(54) ISOLATION OF SUBTERRANEAN ZONES

(76) Inventors: Robert Lance Cook, 934 Caswell Ct., Katy, TX (US) 77450; Kevin Waddell, 11007 Sprucedale Ct., Houston, TX (US) 77070; Lev Ring, 14126 Heatherhill Pl., Houston, TX (US) 77077; David Paul Brisco, 405 Westridge Dr., Duncan, OK (US) 73533

( * ) Notice: Subject to any disclaimer, the term of this patent is extended or adjusted under 35 U.S.C. 154(b) by 42 days.

(21) Appl. No.: 09/969,922

(22) Filed: Oct. 3, 2001

(65) Prior Publication Data

US 2002/0148612 A1 Oct. 17, 2002

Related U.S. Application Data

(63) Continuation-in-part of application No. 09/440,338, filed on Nov. 15, 1999, now Pat. No. 6,328,113.
(60) Provisional application No. 60/108,558, filed on Nov. 16, 1998.

(51) Int. Cl.[7] ..... E21B 33/12
(52) U.S. Cl. ..... 166/387; 166/50; 166/117.6
(58) Field of Search ..... 166/50, 313, 117.5, 166/117.6, 387, 66.6, 205

(56) References Cited

U.S. PATENT DOCUMENTS

| | | | |
|---|---|---|---|
| 46,818 | A | 3/1865 | Patterson |
| 332,184 | A | 12/1885 | Bole |
| 341,237 | A | 5/1886 | Healey |
| 519,805 | A | 5/1894 | Bavier |
| 806,156 | A | 12/1905 | Marshall |
| 958,517 | A | 5/1910 | Mettler |
| 984,449 | A | 2/1911 | Stewart |
| 1,233,888 | A | 7/1917 | Leonard |
| 1,589,781 | A | 6/1926 | Anderson |
| 1,590,357 | A | 6/1926 | Feisthamel |
| 1,880,218 | A | 10/1932 | Simmons |
| 1,981,525 | A | 11/1934 | Price |

(List continued on next page.)

FOREIGN PATENT DOCUMENTS

| | | | |
|---|---|---|---|
| CA | 736288 | 6/1966 | |
| CA | 771462 | 11/1967 | |
| CA | 1171310 | 7/1984 | ..... F16B/13/06 |
| DE | 174521 | 4/1953 | |
| DE | 2458188 | 6/1979 | |
| DE | 203767 | 11/1983 | ..... E21B/43/10 |
| DE | 233607 | 3/1986 | ..... E21B/17/00 |
| DE | 278517 | 5/1990 | ..... B21D/28/28 |
| DE | 10007547 | 9/2000 | ..... E02D/7/28 |
| EP | 0272511 | 12/1987 | |

(List continued on next page.)

OTHER PUBLICATIONS

Halliburton Energy Services, "Halliburton Completion Products" 1996, Page Packers 5–37, United States of America.

(List continued on next page.)

*Primary Examiner*—Frank S. Tsay
(74) *Attorney, Agent, or Firm*—Haynes and Boone LLP; Todd Mattingly

(57) ABSTRACT

One or more subterranean zones are isolated from one or more other subterranean zones using a combination of solid tubulars and perforated tubulars.

58 Claims, 11 Drawing Sheets

U.S. PATENT DOCUMENTS

| | | | | |
|---|---|---|---|---|
| 2,046,870 | A | 7/1936 | Clasen et al. | |
| 2,087,185 | A | 7/1937 | Dillom | |
| 2,122,757 | A | 7/1938 | Scott | |
| 2,160,263 | A | 5/1939 | Fletcher | |
| 2,187,275 | A | 1/1940 | McLennan | |
| 2,204,586 | A | 6/1940 | Grau | |
| 2,214,226 | A | 9/1940 | English | |
| 2,226,804 | A | 12/1940 | Carroll | |
| 2,273,017 | A | 2/1942 | Boynton | |
| 2,301,495 | A | 11/1942 | Abegg | |
| 2,447,629 | A | 8/1948 | Beissinger et al. | |
| 2,500,276 | A | 3/1950 | Church | |
| 2,583,316 | A | 1/1952 | Bannister | |
| 2,734,580 | A | 2/1956 | Layne | |
| 2,796,134 | A | 6/1957 | Binkley | |
| 2,812,025 | A | 11/1957 | Teague et al. | |
| 2,907,589 | A | 10/1959 | Knox | |
| 3,015,500 | A | 1/1962 | Barnett | |
| 3,018,547 | A | 1/1962 | Marskell | |
| 3,067,819 | A | 12/1962 | Gore | |
| 3,104,703 | A | 9/1963 | Rike et al. | |
| 3,111,991 | A | 11/1963 | O'Neal | |
| 3,167,122 | A | 1/1965 | Lang | |
| 3,175,618 | A | 3/1965 | Lang et al. | |
| 3,179,168 | A | 4/1965 | Vincent | |
| 3,188,816 | A | 6/1965 | Koch | |
| 3,191,677 | A | 6/1965 | Kinley | |
| 3,191,680 | A | 6/1965 | Vincent | |
| 3,203,451 | A | 8/1965 | Vincent | |
| 3,203,483 | A | 8/1965 | Vincent | |
| 3,209,546 | A | 10/1965 | Lawton | |
| 3,245,471 | A | 4/1966 | Howard | |
| 3,270,817 | A | 9/1966 | Papaila | |
| 3,297,092 | A | 1/1967 | Jennings | |
| 3,326,293 | A | 6/1967 | Skipper | |
| 3,353,599 | A | 11/1967 | Swift | |
| 3,354,955 | A | 11/1967 | Berry | |
| 3,358,760 | A | 12/1967 | Blagg | |
| 3,358,769 | A | 12/1967 | Berry | |
| 3,364,993 | A | 1/1968 | Skipper | |
| 3,412,565 | A | 11/1968 | Lindsey et al. | |
| 3,419,080 | A | 12/1968 | Lebourg | |
| 3,424,244 | A | 1/1969 | Kinley | |
| 3,477,506 | A | 11/1969 | Malone | |
| 3,489,220 | A | 1/1970 | Kinley | |
| 3,498,376 | A | 3/1970 | Sizer et al. | |
| 3,568,773 | A | 3/1971 | Chencellor | 166/315 |
| 3,665,591 | A | 5/1972 | Kowal | |
| 3,669,190 | A | 6/1972 | Sizer et al. | 166/315 |
| 3,682,256 | A | 8/1972 | Stuart | |
| 3,687,196 | A | 8/1972 | Mullins | 166/217 |
| 3,691,624 | A | 9/1972 | Kinley | 29/523 |
| 3,693,717 | A | 9/1972 | Wuenschel | 166/285 |
| 3,711,123 | A | 1/1973 | Arnold | |
| 3,712,376 | A | 1/1973 | Owen et al. | 166/277 |
| 3,746,068 | A | 7/1973 | Deckert et al. | |
| 3,746,091 | A | 7/1973 | Owen et al. | 166/207 |
| 3,746,092 | A | 7/1973 | Land | 166/207 |
| 3,764,168 | A | 10/1973 | Kisling, III et al. | 285/302 |
| 3,776,307 | A | 12/1973 | Young | 166/125 |
| 3,779,025 | A | 12/1973 | Godley et al. | 61/53.52 |
| 3,780,562 | A | 12/1973 | Kinley | 72/479 |
| 3,785,193 | A | 1/1974 | Kinley et al. | 72/393 |
| 3,797,259 | A | 3/1974 | Kammerer, Jr. | 61/53.68 |
| 3,812,912 | A | 5/1974 | Wuenschel | 166/207 |
| 3,818,734 | A | 6/1974 | Bateman | 72/75 |
| 3,885,298 | A | 5/1975 | Pogonowski | |
| 3,886,954 | A | 6/1975 | Slator et al. | |
| 3,887,006 | A | 6/1975 | Pitts | 166/124 |
| 3,893,718 | A | 7/1975 | Powell | |
| 3,898,163 | A | 8/1975 | Mott | |
| 3,915,478 | A | 10/1975 | Al et al. | |
| 3,935,910 | A | 2/1976 | Gaudy et al. | |
| 3,945,444 | A | 3/1976 | Knudson | 175/92 |
| 3,948,321 | A | 4/1976 | Owen et al. | 166/277 |
| 3,970,336 | A | 7/1976 | O'Sickey et al. | |
| 3,977,473 | A | 8/1976 | Page, Jr. | 166/315 |
| 3,997,193 | A | 12/1976 | Tsuda et al. | 285/47 |
| 4,011,652 | A | 3/1977 | Black | |
| 4,069,573 | A | 1/1978 | Rogers, Jr. et al. | 29/421 R |
| 4,076,287 | A | 2/1978 | Bill et al. | 285/382.4 |
| 4,096,913 | A | 6/1978 | Kenneday et al. | 166/290 |
| 4,098,334 | A | 7/1978 | Crowe | 166/208 |
| 4,152,821 | A | 5/1979 | Scott | |
| 4,190,108 | A | 2/1980 | Webber | |
| 4,205,422 | A | 6/1980 | Hardwick | 29/402.13 |
| 4,253,687 | A | 3/1981 | Maples | 285/332 |
| 4,274,665 | A | 6/1981 | Marsh, Jr. | |
| RE30,802 | E | 11/1981 | Rogers, Jr. | 29/421 R |
| 4,304,428 | A | 12/1981 | Grigorian et al. | |
| 4,359,889 | A | 11/1982 | Kelly | 72/62 |
| 4,363,358 | A | 12/1982 | Ellis | 166/212 |
| 4,366,971 | A | 1/1983 | Lula | |
| 4,368,571 | A | 1/1983 | Cooper, Jr. | 29/421 R |
| 4,379,471 | A | 4/1983 | Kuenzel | |
| 4,380,347 | A | 4/1983 | Sable | |
| 4,391,325 | A | 7/1983 | Baker et al. | 166/208 |
| 4,393,931 | A | 7/1983 | Muse et al. | 166/208 |
| 4,402,372 | A | 9/1983 | Cherrington | |
| 4,407,681 | A | 10/1983 | Ina et al. | |
| 4,411,435 | A | 10/1983 | McStravick | 277/9.5 |
| 4,413,395 | A | 11/1983 | Garnier | |
| 4,413,682 | A | 11/1983 | Callihan et al. | 166/382 |
| 4,420,866 | A | 12/1983 | Mueller | 29/421 R |
| 4,421,169 | A | 12/1983 | Dearth et al. | 166/285 |
| 4,423,889 | A | 1/1984 | Weise | 285/39 |
| 4,423,986 | A | 1/1984 | Skogberg | 405/259 |
| 4,429,741 | A | 2/1984 | Hyland | 166/63 |
| 4,440,233 | A | 4/1984 | Baugh et al. | 166/382 |
| 4,444,250 | A | 4/1984 | Keithahn et al. | |
| 4,462,471 | A | 7/1984 | Hipp | |
| 4,469,356 | A | 9/1984 | Duret et al. | |
| 4,473,245 | A | 9/1984 | Raulins et al. | |
| 4,483,399 | A | 11/1984 | Colgate | 166/308 |
| 4,485,847 | A | 12/1984 | Wentzell | |
| 4,501,327 | A | 2/1985 | Retz | 166/285 |
| 4,505,017 | A | 3/1985 | Schukei | 29/157.3 R |
| 4,508,129 | A | 4/1985 | Brown | |
| 4,511,289 | A | 4/1985 | Herron | 405/259 |
| 4,519,456 | A | 5/1985 | Cochran | |
| 4,526,232 | A | 7/1985 | Hughson et al. | |
| 4,553,776 | A | 11/1985 | Dodd | 285/212 |
| 4,573,248 | A | 3/1986 | Hackett | |
| 4,576,386 | A | 3/1986 | Benson | 277/165 |
| 4,590,995 | A | 5/1986 | Evans | 166/127 |
| 4,592,577 | A | 6/1986 | Ayres et al. | |
| 4,605,063 | A | 8/1986 | Ross | 166/216 |
| 4,611,662 | A | 9/1986 | Harrington | |
| 4,629,218 | A | 12/1986 | Dubois | |
| 4,630,849 | A | 12/1986 | Fukui et al. | |
| 4,632,944 | A | 12/1986 | Thompson | |
| 4,634,317 | A | 1/1987 | Skogberg et al. | 405/259 |
| 4,635,333 | A | 1/1987 | Finch | 29/157.4 |
| 4,637,436 | A | 1/1987 | Stewart, Jr. et al. | 138/89 |
| 4,646,787 | A | 3/1987 | Rush et al. | |
| 4,651,836 | A | 3/1987 | Richards | |
| 4,660,863 | A | 4/1987 | Bailey et al. | |
| 4,662,446 | A | 5/1987 | Brisco et al. | 166/278 |
| 4,669,541 | A | 6/1987 | Bissonnette | |
| 4,682,797 | A | 7/1987 | Hildner | |
| 4,685,191 | A | 8/1987 | Mueller et al. | 29/523 |

4,685,834 A 8/1987 Jordan
4,693,498 A 9/1987 Baugh et al.
4,711,474 A 12/1987 Patrick ..... 285/332.3
4,714,117 A 12/1987 Dech
4,730,851 A 3/1988 Watts ..... 285/4
4,735,444 A 4/1988 Skipper
4,739,916 A 4/1988 Ayres et al.
4,776,394 A 10/1988 Lynde et al.
4,793,382 A 12/1988 Szalvay ..... 138/98
4,796,668 A 1/1989 Depret
4,817,710 A 4/1989 Edwards et al.
4,817,716 A 4/1989 Taylor et al. ..... 166/277
4,827,594 A 5/1989 Cartry et al.
4,828,033 A 5/1989 Frison
4,830,109 A 5/1989 Wedel ..... 166/277
4,865,127 A 9/1989 Koster ..... 166/277
4,872,253 A 10/1989 Carstensen
4,887,646 A 12/1989 Groves
4,892,337 A 1/1990 Gunderson et al.
4,893,658 A 1/1990 Kimura et al.
4,907,828 A 3/1990 Change
4,913,758 A 4/1990 Koster ..... 156/191
4,915,426 A 4/1990 Skipper
4,934,312 A 6/1990 Koster et al. ..... 118/410
4,941,512 A 7/1990 McParland ..... 138/97
4,941,532 A 7/1990 Hurt et al. ..... 166/216
4,942,926 A 7/1990 Lessi
4,958,691 A 9/1990 Hipp
4,968,184 A 11/1990 Reid ..... 405/225
4,971,152 A 11/1990 Koster et al. ..... 166/277
4,976,322 A 12/1990 Abdrakhmanov et al. .... 175/57
4,981,250 A 1/1991 Persson ..... 228/107
5,014,779 A 5/1991 Meling et al. ..... 166/55.7
5,015,017 A 5/1991 Geary
5,031,699 A 7/1991 Artynov et al. ..... 166/285
5,040,283 A 8/1991 Pelgrom ..... 29/447
5,044,676 A 9/1991 Burton et al.
5,052,483 A 10/1991 Hudson ..... 166/55
5,059,043 A 10/1991 Kuhne
5,079,837 A 1/1992 Vanselow
5,083,608 A 1/1992 Abdrakhmanov et al. .... 166/55
5,093,015 A 3/1992 Oldiges
5,095,991 A 3/1992 Milberger
5,107,221 A 4/1992 N'Guyen et al. ..... 328/233
5,119,661 A 6/1992 Abdrakhmanov et al. .... 72/276
5,156,043 A 10/1992 Ose ..... 73/49.8
5,156,223 A 10/1992 Hipp
5,174,376 A 12/1992 Singeetham ..... 166/208
5,181,571 A 1/1993 Mueller et al.
5,197,553 A 3/1993 Leturno ..... 175/57
5,209,600 A 5/1993 Koster ..... 403/344
5,226,492 A 7/1993 Solaeche P. et al. ..... 166/196
5,286,393 A 2/1994 Oldiges et al.
5,314,209 A 5/1994 Kuhne
5,318,122 A 6/1994 Murray et al. ..... 166/313
5,318,131 A 6/1994 Baker ..... 166/382
5,325,923 A 7/1994 Surjaatmadja et al. ..... 166/308
5,332,038 A 7/1994 Tapp et al. ..... 166/278
5,332,049 A 7/1994 Tew
5,333,692 A 8/1994 Baugh et al.
5,335,736 A 8/1994 Windsor ..... 175/57
5,337,808 A 8/1994 Graham ..... 166/91
5,337,823 A 8/1994 Nobileau
5,339,894 A 8/1994 Stotler
5,343,949 A 9/1994 Ross et al.
5,346,007 A 9/1994 Dillon et al.
5,348,087 A 9/1994 Williamson, Jr. ..... 166/115
5,348,093 A 9/1994 Wood et al.
5,348,095 A 9/1994 Worrall et al. ..... 166/380
5,348,668 A 9/1994 Oldiges et al.
5,351,752 A 10/1994 Wood et al.
5,360,292 A 11/1994 Allen et al. ..... 405/249
5,361,843 A 11/1994 Shy et al. ..... 166/297
5,366,010 A 11/1994 Zwart ..... 166/120
5,366,012 A 11/1994 Lohbeck ..... 166/277
5,368,075 A 11/1994 Baro et al.
5,370,425 A 12/1994 Dougherty et al.
5,375,661 A 12/1994 Daneshy et al.
5,388,648 A 2/1995 Jordan, Jr. ..... 166/380
5,390,735 A 2/1995 Williamson, Jr. ..... 166/115
5,390,742 A 2/1995 Dines et al. ..... 166/297
5,396,957 A 3/1995 Surjaatmadja et al. ..... 166/308
5,405,171 A 4/1995 Allen et al.
5,425,559 A 6/1995 Nobileau ..... 285/330
5,426,130 A 6/1995 Thurder et al.
5,435,395 A 7/1995 Connell
5,439,320 A 8/1995 Abrams ..... 405/154
5,447,201 A 9/1995 Mohn
5,454,419 A 10/1995 Vloedman
5,467,822 A 11/1995 Zwart ..... 166/179
5,472,055 A 12/1995 Simson et al.
5,474,334 A 12/1995 Eppink
5,494,106 A 2/1996 Gueguen et al. ..... 166/277
5,507,343 A 4/1996 Carlton et al. ..... 166/277
5,511,620 A 4/1996 Baugh et al.
5,524,937 A 6/1996 Sides, III et al.
5,535,824 A 7/1996 Hudson ..... 166/207
5,536,422 A 7/1996 Oldiges et al.
5,576,485 A 11/1996 Serata
5,606,792 A 3/1997 Schafer ..... 29/727
5,611,399 A 3/1997 Richard et al.
5,613,557 A 3/1997 Blount et al. ..... 166/277
5,617,918 A 4/1997 Cooksey et al. ..... 166/115
5,642,560 A 7/1997 Tabuchi et al.
5,642,781 A 7/1997 Richard
5,664,327 A 9/1997 Swars ..... 29/888.08
5,667,011 A 9/1997 Gill et al. ..... 166/295
5,667,252 A 9/1997 Schafer et al. ..... 285/15
5,685,369 A 11/1997 Ellis et al. ..... 166/195
5,689,871 A 11/1997 Carstensen
5,695,008 A 12/1997 Bertet et al. ..... 166/187
5,695,009 A 12/1997 Hipp
5,718,288 A 2/1998 Bertet et al. ..... 166/287
5,775,422 A 7/1998 Wong et al.
5,785,120 A 7/1998 Smalley et al. ..... 166/55
5,787,933 A 8/1998 Russ et al.
5,791,419 A 8/1998 Valisalo ..... 175/53
5,794,702 A 8/1998 Nobileau ..... 166/380
5,797,454 A 8/1998 Hipp
5,829,520 A 11/1998 Johnson ..... 166/250.01
5,829,524 A 11/1998 Flanders et al. ..... 166/277
5,833,001 A 11/1998 Song et al.
5,845,945 A 12/1998 Carstensen
5,849,188 A 12/1998 Voll et al.
5,857,524 A 1/1999 Harris ..... 166/382
5,875,851 A 3/1999 Vick, Jr. et al. ..... 166/386
5,885,941 A 3/1999 Sateva et al.
5,901,789 A 5/1999 Donnelly et al. ..... 166/381
5,918,677 A 7/1999 Head
5,924,745 A 7/1999 Campbell ..... 285/90
5,931,511 A 8/1999 DeLange et al.
5,944,100 A 8/1999 Hipp
5,944,107 A 8/1999 Ohmer ..... 166/313
5,951,207 A 9/1999 Chen ..... 405/232
5,957,195 A 9/1999 Bailey et al. ..... 166/55
5,979,560 A 11/1999 Nobileau ..... 166/381
5,984,369 A 11/1999 Crook et al.
5,984,568 A 11/1999 Lohbeck ..... 403/375
6,012,522 A 1/2000 Donnelly et al. ..... 166/276
6,012,523 A 1/2000 Campbell et al. ..... 166/277
6,012,874 A 1/2000 Groneck et al. ..... 405/239
6,017,168 A 1/2000 Fraser et al. ..... 405/224.4

| | | | | |
|---|---|---|---|---|
| 6,021,850 | A | 2/2000 | Wood et al. | 166/380 |
| 6,029,748 | A | 2/2000 | Forsyth et al. | 166/380 |
| 6,035,954 | A | 3/2000 | Hipp | |
| 6,044,906 | A | 4/2000 | Saltel | 166/187 |
| 6,047,505 | A | 4/2000 | Willow | |
| 6,047,774 | A | 4/2000 | Allen | |
| 6,050,341 | A | 4/2000 | Metcalf | 166/383 |
| 6,050,346 | A | 4/2000 | Hipp | |
| 6,056,059 | A | 5/2000 | Ohmer | 166/313 |
| 6,062,324 | A | 5/2000 | Hipp | |
| 6,065,500 | A | 5/2000 | Metcalfe | 138/118 |
| 6,070,671 | A | 6/2000 | Cumming et al. | 166/381 |
| 6,074,133 | A | 6/2000 | Kelsey | 405/244 |
| 6,078,031 | A | 6/2000 | Bliault et al. | 219/607 |
| 6,079,495 | A | 6/2000 | Ohmer | 166/313 |
| 6,085,838 | A | 7/2000 | Vercaemer et al. | 166/277 |
| 6,089,320 | A | 7/2000 | LaGrange | 166/313 |
| 6,098,717 | A | 8/2000 | Bailey et al. | 166/382 |
| 6,102,119 | A | 8/2000 | Raines | 166/244.1 |
| 6,109,355 | A | 8/2000 | Reid | |
| 6,112,818 | A | 9/2000 | Campbell | 166/384 |
| 6,131,265 | A | 10/2000 | Bird | |
| 6,135,208 | A | 10/2000 | Gano et al. | 166/313 |
| 6,142,230 | A | 11/2000 | Smalley et al. | |
| 6,182,775 | B1 | 2/2001 | Hipp | |
| 6,196,336 | B1 | 3/2001 | Fincher et al. | |
| 6,226,855 | B1 | 5/2001 | Maine | 29/507 |
| 6,250,385 | B1 | 6/2001 | Montaron | 166/207 |
| 6,263,968 | B1 | 7/2001 | Freeman et al. | |
| 6,263,972 | B1 | 7/2001 | Richard et al. | |
| 6,283,211 | B1 | 9/2001 | Vloedman | |
| 6,315,043 | B1 | 11/2001 | Farrant et al. | |
| 6,328,113 | B1 | 12/2001 | Cook | |
| 6,345,431 | B1 | 2/2002 | Greig | |
| 6,354,373 | B1 | 3/2002 | Vercaemer et al. | |
| 6,409,175 | B1 | 6/2002 | Evans et al. | |
| 6,419,033 | B1 | 7/2002 | Hahn et al. | |
| 6,419,147 | B1 | 7/2002 | Daniel | |
| 6,425,444 | B1 | 7/2002 | Metcalfe et al. | |
| 6,446,724 | B2 | 9/2002 | Baugh et al. | |
| 6,454,013 | B1 | 9/2002 | Metcalfe | |
| 6,457,532 | B1 | 10/2002 | Simpson | |
| 6,457,533 | B1 | 10/2002 | Metcalfe | |
| 6,457,749 | B1 | 10/2002 | Heijnen | |
| 6,460,615 | B1 | 10/2002 | Heijnen | |
| 6,470,966 | B2 | 10/2002 | Cook et al. | |
| 6,517,126 | B1 | 2/2003 | Peterson et al. | |
| 6,527,049 | B2 | 3/2003 | Metcalfe et al. | |
| 2001/0002626 | A1 | 6/2001 | Frank et al. | 175/57 |
| 2001/0020532 | A1 | 9/2001 | Baugh et al. | |
| 2002/0011339 | A1 | 1/2002 | Murray | |
| 2002/0014339 | A1 | 2/2002 | Ross | |
| 2002/0062956 | A1 | 5/2002 | Murray et al. | |
| 2002/0066576 | A1 | 6/2002 | Cook et al. | |
| 2002/0066578 | A1 | 6/2002 | Broome | |
| 2002/0070023 | A1 | 6/2002 | Turner et al. | |
| 2002/0070031 | A1 | 6/2002 | Voll et al. | |
| 2002/0079101 | A1 | 6/2002 | Baugh et al. | |
| 2002/0084070 | A1 | 7/2002 | Voll et al. | |
| 2002/0092654 | A1 | 7/2002 | Coronado et al. | |
| 2002/0139540 | A1 | 10/2002 | Lauritzen | |
| 2002/0144822 | A1 | 10/2002 | Hackworth et al. | |
| 2002/0148612 | A1 | 10/2002 | Cook et al. | |
| 2002/0185274 | A1 | 12/2002 | Simpson et al. | |
| 2002/0189816 | A1 | 12/2002 | Cook et al. | |
| 2002/0195256 | A1 | 12/2002 | Maguire et al. | |
| 2003/0024711 | A1 | 2/2003 | Simpson et al. | |
| 2003/0056991 | A1 | 3/2003 | Hahn et al. | |

FOREIGN PATENT DOCUMENTS

| | | | | |
|---|---|---|---|---|
| EP | 0553566 | A1 | 12/1992 | |
| EP | 0633391 | A2 | 1/1995 | E21B/34/14 |
| EP | 0713953 | B1 | 11/1995 | |
| EP | 0823534 | | 2/1998 | E21B/7/06 |
| EP | 0881354 | | 12/1998 | E21B/43/10 |
| EP | 0881359 | | 12/1998 | E21D/9/08 |
| EP | 0899420 | | 3/1999 | E21B/43/10 |
| EP | 0937861 | | 8/1999 | E21B/43/10 |
| EP | 0952305 | | 10/1999 | E21B/43/10 |
| EP | 0952306 | | 10/1999 | E21B/43/10 |
| EP | 1152120 | A2 | 11/2001 | |
| FR | 2717855 | | 9/1995 | E21B/17/00 |
| FR | 2741907 | | 6/1997 | E21B/7/20 |
| FR | 2771133 | A | 5/1999 | |
| FR | 2780751 | | 1/2000 | E21B/33/127 |
| GB | 557823 | | 12/1943 | |
| GB | 961750 | | 6/1964 | |
| GB | 1062610 | | 3/1967 | |
| GB | 1111536 | | 5/1968 | |
| GB | 1448304 | | 9/1976 | |
| GB | 1460864 | | 1/1977 | |
| GB | 1542847 | | 3/1979 | |
| GB | 1563740 | | 3/1980 | |
| GB | 2058877 | | 4/1981 | |
| GB | 2108228 | A | 5/1983 | |
| GB | 2115860 | | 9/1983 | |
| GB | 2211573 | A | 7/1989 | |
| GB | 2216926 | | 10/1989 | |
| GB | 2243191 | | 10/1991 | |
| GB | 2256910 | | 12/1992 | F16L/9/18 |
| GB | 2305682 | | 4/1997 | |
| GB | 2325949 | A | 5/1998 | |
| GB | 2322655 | | 9/1998 | E21B/23/04 |
| GB | 2326896 | | 1/1999 | E21B/17/00 |
| GB | 2329916 | | 4/1999 | E21B/17/00 |
| GB | 2329918 | | 4/1999 | E21B/29/00 |
| GB | 2336383 | | 10/1999 | E21B/43/08 |
| GB | 2355738 | A | 4/2000 | |
| GB | 2343691 | | 5/2000 | E21B/43/14 |
| GB | 2344606 | | 6/2000 | E21B/33/14 |
| GB | 2368865 | A | 7/2000 | |
| GB | 2346165 | | 8/2000 | E21B/43/10 |
| GB | 2346632 | | 8/2000 | E21B/43/10 |
| GB | 2347445 | | 9/2000 | E21B/7/20 |
| GB | 2347446 | A | 9/2000 | E21B/43/10 |
| GB | 2347950 | A | 9/2000 | E21B/33/047 |
| GB | 2347952 | A | 9/2000 | E21B/43/10 |
| GB | 2348223 | A | 9/2000 | E21B/7/20 |
| GB | 2348657 | A | 10/2000 | E21B/43/10 |
| GB | 2357099 | A | 12/2000 | |
| GB | 2350137 | B | 8/2001 | |
| GB | 2359837 | B | 4/2002 | |
| GB | 2370301 | A | 6/2002 | |
| GB | 2371064 | A | 7/2002 | |
| GB | 2371574 | A | 7/2002 | |
| GB | 2367842 | A | 10/2002 | |
| GB | 2375560 | A | 11/2002 | |
| JP | 208458 | | 10/1985 | C22C/38/52 |
| JP | 64-75715 | | 3/1989 | |
| JP | 102875 | | 4/1995 | E21D/5/10 |
| JP | 94068 | | 4/2000 | |
| JP | 107870 | | 4/2000 | |
| JP | 162192 | | 6/2000 | G01N/29/14 |
| NL | 9001081 | | 12/1991 | E21B/33/12 |
| RO | 113267 | | 5/1998 | E21B/10/32 |
| RU | 1659621 | A1 | 6/1991 | |
| RU | 1786241 | | 1/1993 | E21B/33/10 |
| RU | 1804543 | | 3/1993 | E21B/29/10 |
| RU | 1810482 | | 4/1993 | E21B/29/10 |
| RU | 1818459 | | 5/1993 | E21B/29/10 |
| RU | 2016345 | | 7/1994 | F16L/58/00 |
| RU | 2039214 | | 7/1995 | E21B/43/00 |

| | | | |
|---|---|---|---|
| RU | 2056201 | 3/1996 | B21D/39/10 |
| RU | 2064357 | 7/1996 | B21D/39/10 |
| RU | 2068940 | 11/1996 | E21B/29/10 |
| RU | 2068943 | 11/1996 | E21B/33/13 |
| RU | 2079633 | 5/1997 | E21B/7/06 |
| RU | 2083798 | 7/1997 | E21B/33/12 |
| RU | 2091655 | 9/1997 | F16L/9/02 |
| RU | 2095179 | 11/1997 | B21D/39/04 |
| RU | 2105128 | 2/1998 | E21B/29/00 |
| RU | 2108445 | 4/1998 | E21B/33/13 |
| RU | 2144128 | 1/2000 | E21B/29/10 |
| SU | 350833 | 9/1972 | C21C/5/52 |
| SU | 511468 | 9/1976 | |
| SU | 607950 | 5/1978 | E21B/29/00 |
| SU | 612004 | 5/1978 | E21B/29/00 |
| SU | 620582 | 7/1978 | E21B/29/00 |
| SU | 641070 | 1/1979 | |
| SU | 832049 | 5/1981 | |
| SU | 853089 | 8/1981 | |
| SU | 874952 | 10/1981 | E21B/17/28 |
| SU | 894169 | 1/1982 | E21B/7/28 |
| SU | 899850 | 1/1982 | E21B/33/00 |
| SU | 907220 | 2/1982 | E21B/33/12 |
| SU | 909114 | 2/1982 | |
| SU | 953172 | 8/1982 | E21B/7/20 |
| SU | 959878 | 9/1982 | B21D/41/02 |
| SU | 976019 | 11/1982 | E21B/29/10 |
| SU | 976020 | 11/1982 | E21B/29/10 |
| SU | 989038 | 1/1983 | E21B/29/10 |
| SU | 1002514 | 3/1983 | E21B/29/10 |
| SU | 1041671 | 9/1983 | E21B/29/10 |
| SU | 1051222 | 10/1983 | E21B/29/10 |
| SU | 1086118 | 4/1984 | E21B/29/00 |
| SU | 1158400 | 5/1985 | B60M/3/00 |
| SU | 1212575 | 2/1986 | E21B/7/28 |
| SU | 1250637 | 8/1986 | E21B/7/20 |
| SU | 1324722 A1 | 7/1987 | |
| SU | 1411434 | 7/1988 | E21B/29/10 |
| SU | 1430498 | 10/1988 | E21B/29/10 |
| SU | 1432190 | 10/1988 | E21B/29/10 |
| SU | 1601330 | 10/1990 | E21B/29/10 |
| SU | 1627663 | 2/1991 | E21B/29/10 |
| SU | 1663179 | 7/1991 | E21B/29/10 |
| SU | 1663180 | 7/1991 | E21B/29/10 |
| SU | 1677225 | 9/1991 | E21B/7/28 |
| SU | 1677248 | 9/1991 | E21B/29/10 |
| SU | 1686123 | 10/1991 | E21B/29/10 |
| SU | 1686124 | 10/1991 | E21B/29/10 |
| SU | 1686125 | 10/1991 | E21B/29/10 |
| SU | 1698413 | 12/1991 | E21B/7/28 |
| SU | 1710694 | 2/1992 | E21B/29/10 |
| SU | 1730429 | 4/1992 | E21B/33/13 |
| SU | 1745873 | 7/1992 | E21B/29/10 |
| SU | 1747673 | 7/1992 | E21B/29/10 |
| SU | 1749267 | 7/1992 | C21D/9/08 |
| SU | 1295799 | 2/1995 | E21B/29/10 |
| WO | 8100132 | 1/1981 | E21B/43/10 |
| WO | 9005598 | 3/1990 | B21C/3/08 |
| WO | 9201859 | 2/1992 | E21D/20/00 |
| WO | 9208875 | 5/1992 | E21B/43/14 |
| WO | 9325799 | 12/1993 | E21B/43/10 |
| WO | 9325800 | 12/1993 | E21B/43/10 |
| WO | 9421887 | 9/1994 | E21B/33/14 |
| WO | 9425655 | 11/1994 | D04C/1/06 |
| WO | 9503476 | 2/1995 | E21B/43/10 |
| WO | 9601937 | 1/1996 | E21B/33/127 |
| WO | 9621083 | 7/1996 | E21B/43/10 |
| WO | 9626350 | 8/1996 | E21B/43/11 |
| WO | 9637681 | 11/1996 | E21B/17/08 |
| WO | 9706346 | 2/1997 | E21B/43/10 |
| WO | 9711306 | 3/1997 | F16L/55/165 |
| WO | 9717524 | 5/1997 | E21B/43/08 |
| WO | 9717526 | 5/1997 | E21B/43/10 |
| WO | 9717527 | 5/1997 | E21B/43/10 |
| WO | 9720130 | 6/1997 | E21B/43/10 |
| WO | 9721901 | 6/1997 | E21B/17/08 |
| WO | 9800626 | 1/1998 | E21B/43/10 |
| WO | 9807957 | 2/1998 | E21B/43/10 |
| WO | 9809053 | 3/1998 | E21B/33/14 |
| WO | 9822690 | 5/1998 | E21B/17/08 |
| WO | 9826152 | 6/1998 | E21B/17/08 |
| WO | 9842947 | 10/1998 | E21B/17/08 |
| WO | 9849423 | 11/1998 | E21B/43/10 |
| WO | 9902818 | 1/1999 | E21B/43/10 |
| WO | 9904135 | 1/1999 | E21B/23/00 |
| WO | 9906670 | 2/1999 | E21B/43/10 |
| WO | 9908827 | 2/1999 | B23K/13/02 |
| WO | 9908828 | 2/1999 | |
| WO | 9918328 | 4/1999 | E21B/23/01 |
| WO | 9923354 | 5/1999 | E21B/43/10 |
| WO | 9925524 | 5/1999 | B26F/1/00 |
| WO | 9925951 | 5/1999 | E21B/43/10 |
| WO | 9935368 | 7/1999 | E21B/43/10 |
| WO | 9943923 | 9/1999 | E21B/33/13 |
| WO | 0001926 | 1/2000 | E21B/43/26 |
| WO | 0004271 | 1/2000 | E21B/17/07 |
| WO | 0008301 | 2/2000 | E21B/43/08 |
| WO | 0026500 | 5/2000 | E21B/19/22 |
| WO | 0026501 | 5/2000 | E21B/23/01 |
| WO | 0026502 | 5/2000 | E21B/29/10 |
| WO | 0031375 | 6/2000 | E21B/43/10 |
| WO | 0037767 | 6/2000 | E21B/29/00 |
| WO | 0037768 | 6/2000 | E21B/29/10 |
| WO | 0037771 | 6/2000 | E21B/43/10 |
| WO | 0037772 | 6/2000 | E21B/43/10 |
| WO | 0039432 | 7/2000 | E21B/43/10 |
| WO | 0046484 | 8/2000 | E21B/43/10 |
| WO | 0050727 | 8/2000 | E21B/7/08 |
| WO | 0050732 | 8/2000 | E21B/43/10 |
| WO | 0050733 | 8/2000 | E21B/43/10 |
| WO | 0077431 A2 | 12/2000 | |
| WO | WO01/04535 A1 | 1/2001 | |
| WO | WO01/83943 A1 | 11/2001 | |
| WO | WO02/25059 A1 | 3/2002 | |
| WO | WO02/095181 A1 | 5/2002 | |
| WO | WO02/075107 A1 | 9/2002 | |
| WO | WO02/077411 A1 | 10/2002 | |
| WO | WO02/081863 A1 | 10/2002 | |
| WO | WO02/081864 A2 | 10/2002 | |
| WO | WO02/086285 A1 | 10/2002 | |
| WO | WO02/086286 A2 | 10/2002 | |
| WO | WO02/090713 | 11/2002 | |
| WO | WO02/103150 A2 | 12/2002 | |
| WO | WO03/012255 A1 | 2/2003 | |

OTHER PUBLICATIONS

Search Report to Application No. GB 0003251.6, Claims Searched 1–5, Jul. 13, 2000.

Search Report to Application No. GB 0004285.3, Claims Searched 2–3, 8–9, 13–16, Jan. 17, 2001.

Search Report to Application No. GB 0005399.1, Claims Searched 25–29, Feb. 15, 2001.

Search Report to Application No. GB 9926450.9, Claims Searched 1–8, Feb. 28, 2000.

Search Report to Application No. GB 9930398.4, Claims Searched 1–35, Jun. 27, 2000.

International Search Report, Application No. PCT/US00/30022, Oct. 31, 2000.

International Search Report, Application No. PCT/US01/19014, Jun. 12, 2001.

Examination Report, Application No. GB 9926450.9, May 15, 2002.
Search Report to Application No. 1999 5593, Claims 1–8., Aug. 20, 2002.
Examination Report, Application No. GB 9926450.9, Nov. 22, 2002.
Search Report to Application No. GB 0219757.2, Claims Searched Claims 1–7, Nov. 25, 2002.
Search Report to Application No. GB 0220872.6, Claims Searched Claims 1–4, Dec. 5, 2002.
Search Report to Application No. GB 0225505.7, Claim Searched 1, Mar. 5, 2003.
Search Report to Application No. GB 0220872.6, Claims Searched 6, 7–8, 9–12, 13, 14, 15–16, 17–19, 20, 21–22, 23, 24–25, 26–37, 38–51, 52–61, Mar. 13, 2003.
Search Report to Application No. GB 0219757.2; Claims Searched 9–13; Jan. 20, 2003.

Search Report to Application No. GB 0004285.3, Claims Searched 2–3, 8–9, 13–16, Jan. 17, 2001.

Search Report to Application No. GB 0005399.1, Claims Searched 25–29, Feb. 15, 2001.

Search Report to Application No. GB 9930398.4, Claims Searched 1–35, Jun. 27, 2000.

Search Report to Application No. GB 9926449.1, Claims Searched 6, 7, 8, 74–81, and 82–88, Jul. 4, 2001.

International Search Report, Application No. PCT/US01/04753, Jun. 17, 2001.

ISOLATION OF SUBTERRANEAN ZONES

CROSS REFERENCE TO RELATED APPLICATIONS

This application is a continuation-in-part of U.S. patent application Ser. No. 09/440,338, filed on November 15, 1999, now U.S. Pat. No. 6,328,113, which claimed the benefit of the filing date of U.S. provisional patent application serial No. 60/108,558, filed on Nov. 16, 1998, the disclosures of which are incorporated herein by reference.

The present application is related to the following: (1) U.S. patent application Ser. No. 09/454,139, filed on Dec. 3, 1999, now Pat. No. 6,497,289, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application serial No. PCT/US00/18635, filed on Jul. 9, 2000, (11) U.S. provisional patent application serial No. 60/162,671, filed on Nov. 1, 1999, (12) U.S. provisional patent application serial No. 60/154,047, filed on Sep. 16, 1999, (13) U.S. provisional patent application serial No. 60/159,082, filed on Oct. 12, 1999, (14) U.S. provisional patent application serial No. 60/159,039, filed on Oct. 12, 1999, (15) U.S. provisional patent application serial No. 60/159,033, filed on Oct. 12, 1999, (16) U.S. provisional patent application serial No. 60/212,359, filed on Jun. 19, 2000, (17) U.S. provisional patent application serial No. 60/165,228, filed on Nov. 12, 1999, (18) U.S. provisional patent application serial No. 60/221,443, filed on Jul. 28, 2000, (19) U.S. provisional patent application serial No. 60/221,645, filed on Jul. 28, 2000, (20) U.S. provisional patent application serial No. 60/233,638, filed on Sep. 18, 2000, (21) U.S. provisional patent application serial No. 60/237,334, filed on Oct. 2, 2000, (22) U.S. provisional patent application serial No. 60/270,007, filed on Feb. 20, 2001; (23) U.S. provisional patent application serial No. 60/262,434, filed on Jan. 17, 2001; (24) U.S. provisional patent application serial No. 60/259,486, filed on Jan. 3, 2001; (25) U.S. provisional patent application serial No. 60/303,940, filed on Jul. 6, 2001; (26) U.S. provisional patent application serial No. 60/313,453, filed on Aug. 20, 2001; (27) U.S. provisional patent application serial No. 60/317,985, filed on Sep. 6, 2001; and (28) U.S. provisional patent application serial No. 60/318,386, filed on Sep. 10, 2001, the disclosures of which are incorporated herein by reference.

BACKGROUND OF THE INVENTION

This invention relates generally to oil and gas exploration, and in particular to isolating certain subterranean zones to facilitate oil and gas exploration.

During oil exploration, a wellbore typically traverses a number of zones within a subterranean formation. Some of these subterranean zones will produce oil and gas, while others will not. Further, it is often necessary to isolate subterranean zones from one another in order to facilitate the exploration for and production of oil and gas. Existing methods for isolating subterranean production zones in order to facilitate the exploration for and production of oil and gas are complex and expensive.

The present invention is directed to overcoming one or more of the limitations of the existing processes for isolating subterranean zones during oil and gas exploration.

SUMMARY OF THE INVENTION

According to one aspect of the present invention, an apparatus is provided that includes a zonal isolation assembly that includes one or more solid tubular members, each solid tubular member including one or more external seals, and one or more perforated tubular members coupled to the solid tubular members, and a shoe coupled to the zonal isolation assembly.

According to another aspect of the present invention, an apparatus is provided that includes a zonal isolation assembly that includes one or more primary solid tubulars, each primary solid tubular including one or more external annular seals, n perforated tubulars coupled to the primary solid tubulars, and n−1 intermediate solid tubulars coupled to and interleaved among the perforated tubulars, each intermediate solid tubular including one or more external annular seals, and a shoe coupled to the zonal isolation assembly.

According to another aspect of the present invention, a method of isolating a first subterranean zone from a second subterranean zone in a wellbore is provided that includes positioning one or more primary solid tubulars within the wellbore, the primary solid tubulars traversing the first subterranean zone, positioning one or more perforated tubulars within the wellbore, the perforated tubulars traversing the second subterranean zone, fluidicly coupling the perforated tubulars and the primary solid tubulars, and preventing the passage of fluids from the first subterranean zone to the second subterranean zone within the wellbore external to the solid and perforated tubulars.

According to another aspect of the present invention, a method of extracting materials from a producing subterranean zone in a wellbore, at least a portion of the wellbore including a casing, is provided that includes positioning one or more primary solid tubulars within the wellbore, fluidicly coupling the primary solid tubulars with the casing, positioning one or more perforated tubulars within the wellbore, the perforated tubulars traversing the producing subterranean zone, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone.

According to another aspect of the present invention, an apparatus is provided that includes a subterranean formation including a wellbore, a zonal isolation assembly at least partially positioned within the wellbore that includes one or more solid tubular members, each solid tubular member including one or more external seals, and one or more perforated tubular members coupled to the solid tubular members, and a shoe positioned within the wellbore coupled to the zonal isolation assembly, wherein at least one of the solid tubular members and the perforated tubular members are formed by a radial expansion process performed within the wellbore.

According to another aspect of the present invention, an apparatus is provided that includes a subterranean formation including a wellbore, a zonal isolation assembly positioned within the wellbore that includes one or more primary solid tubulars, each primary solid tubular including one or more external annular seals, n perforated tubulars positioned coupled to the primary solid tubulars, and n−1 intermediate solid tubulars coupled to and interleaved among the perforated tubulars, each intermediate solid tubular including one or more external annular seals, and a shoe coupled to the zonal isolation assembly, wherein at least one of the primary solid tubulars, the perforated tubulars, and the intermediate solid tubulars are formed by a radial expansion process performed within the wellbore.

According to another aspect of the present invention, a method of isolating a first subterranean zone from a second subterranean zone in a wellbore is provided that includes positioning one or more primary solid tubulars within the wellbore, the primary solid tubulars traversing the first subterranean zone, positioning one or more perforated tubulars within the wellbore, the perforated tubulars traversing the second subterranean zone, radially expanding at least one of the primary solid tubulars and perforated tubulars within the wellbore, fluidicly coupling the perforated tubulars and the primary solid tubulars, and preventing the passage of fluids from the first subterranean zone to the second subterranean zone within the wellbore external to the primary solid tubulars and perforated tubulars.

According to another aspect of the present invention, a method of extracting materials from a producing subterranean zone in a wellbore, at least a portion of the wellbore including a casing, is provided that includes positioning one or more primary solid tubulars within the wellbore, positioning one or more perforated tubulars within the wellbore, the perforated tubulars traversing the producing subterranean zone, radially expanding at least one of the primary solid tubulars and the perforated tubulars within the wellbore, fluidicly coupling the primary solid tubulars with the casing, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone.

According to another aspect of the present invention, an apparatus is provided that includes a subterranean formation including a wellbore, a zonal isolation assembly positioned within the wellbore that includes n solid tubular members positioned within the wellbore, each solid tubular member including one or more external seals, and n−1 perforated tubular members positioned within the wellbore coupled to and interleaved among the solid tubular members, and a shoe positioned within the wellbore coupled to the zonal isolation assembly.

According to another aspect of the present invention, a system for isolating a first subterranean zone from a second subterranean zone in a wellbore is provided that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for fluidicly coupling the perforated tubulars and the primary solid tubulars, and means for preventing the passage of fluids from the first subterranean zone to the second subterranean zone within the wellbore external to the primary solid tubulars and the perforated tubulars.

According to another aspect of the present invention, a system for extracting materials from a producing subterranean zone in a wellbore, at least a portion of the wellbore including a casing, is provided that includes means for positioning one or more primary solid tubulars within the wellbore, means for fluidicly coupling the primary solid tubulars with the casing, means for positioning one or more perforated tubulars within the wellbore, the perforated tubulars traversing the producing subterranean zone, means for fluidicly coupling the perforated tubulars with the primary solid tubulars, means for fluidicly isolating the producing subterranean zone from at least one other subterranean zone within the wellbore, and means for fluidicly coupling at least one of the perforated tubulars with the producing subterranean zone.

According to another aspect of the present invention, a system for isolating a first subterranean zone from a second subterranean zone in a wellbore is provided that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for radially expanding at least one of the primary solid tubulars and perforated tubulars within the wellbore, means for fluidicly coupling the perforated tubulars and the primary solid tubulars, and means for preventing the passage of fluids from the first subterranean zone to the second subterranean zone within the wellbore external to the primary solid tubulars and perforated tubulars.

According to another aspect of the present invention, a system for extracting materials from a producing subterranean zone in a wellbore, at least a portion of the wellbore including a casing, is provided that includes means for positioning one or more primary solid tubulars within the wellbore, means for positioning one or more perforated tubulars within the wellbore, the perforated tubulars traversing the producing subterranean zone, means for radially expanding at least one of the primary solid tubulars and the perforated tubulars within the wellbore, means for fluidicly coupling the primary solid tubulars with the casing, means for fluidicly coupling the perforated tubulars with the solid tubulars, means for fluidicly isolating the producing subterranean zone from at least one other subterranean zone within the wellbore, and means for fluidicly coupling at least one of the perforated tubulars with the producing subterranean zone.

According to another aspect of the present invention, a system for isolating subterranean zones traversed by a wellbore is also provided that includes a tubular support member defining a first passage, a tubular expansion cone defining a second passage fluidicly coupled to the first passage coupled to an end of the tubular support member and comprising a tapered end, a tubular liner coupled to and supported by the tapered end of the tubular expansion cone, and a shoe defining a valveable passage coupled to an end of the tubular liner, wherein the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the other tubular members are greater than or equal to the outside diameter of the tubular expansion cone.

According to another aspect of the present invention, a method of isolating subterranean zones traversed by a wellbore is also provided that includes positioning a tubular liner within the wellbore, and radially expanding one or more discrete portions of the tubular liner into engagement with the wellbore. In an exemplary embodiment, a plurality of discrete portions of the tubular liner are radially expanded into engagement with the wellbore.

According to another aspect of the present invention, a system for isolating subterranean zones traversed by a wellbore is also provided that includes means for positioning a tubular liner within the wellbore, and means for radially expanding one or more discrete portions of the tubular liner into engagement with the wellbore.

According to another aspect of the present invention, an apparatus for isolating subterranean zones is also provided that includes a subterranean formation defining a borehole, and a tubular liner positioned in and coupled to the borehole at one or more discrete locations.

DETAILED DESCRIPTION OF THE ILLUSTRATIVE EMBODIMENTS

An apparatus and method for isolating one or more subterranean zones from one or more other subterranean zones is provided. The apparatus and method permits a producing zone to be isolated from a nonproducing zone using a combination of solid and slotted tubulars. In the production mode, the teachings of the present disclosure may be used in combination with conventional, well known, production completion equipment and methods using a series of packers, solid tubing, perforated tubing, and sliding sleeves, which will be inserted into the disclosed apparatus to permit the commingling and/or isolation of the subterranean zones from each other.

Figure 1:
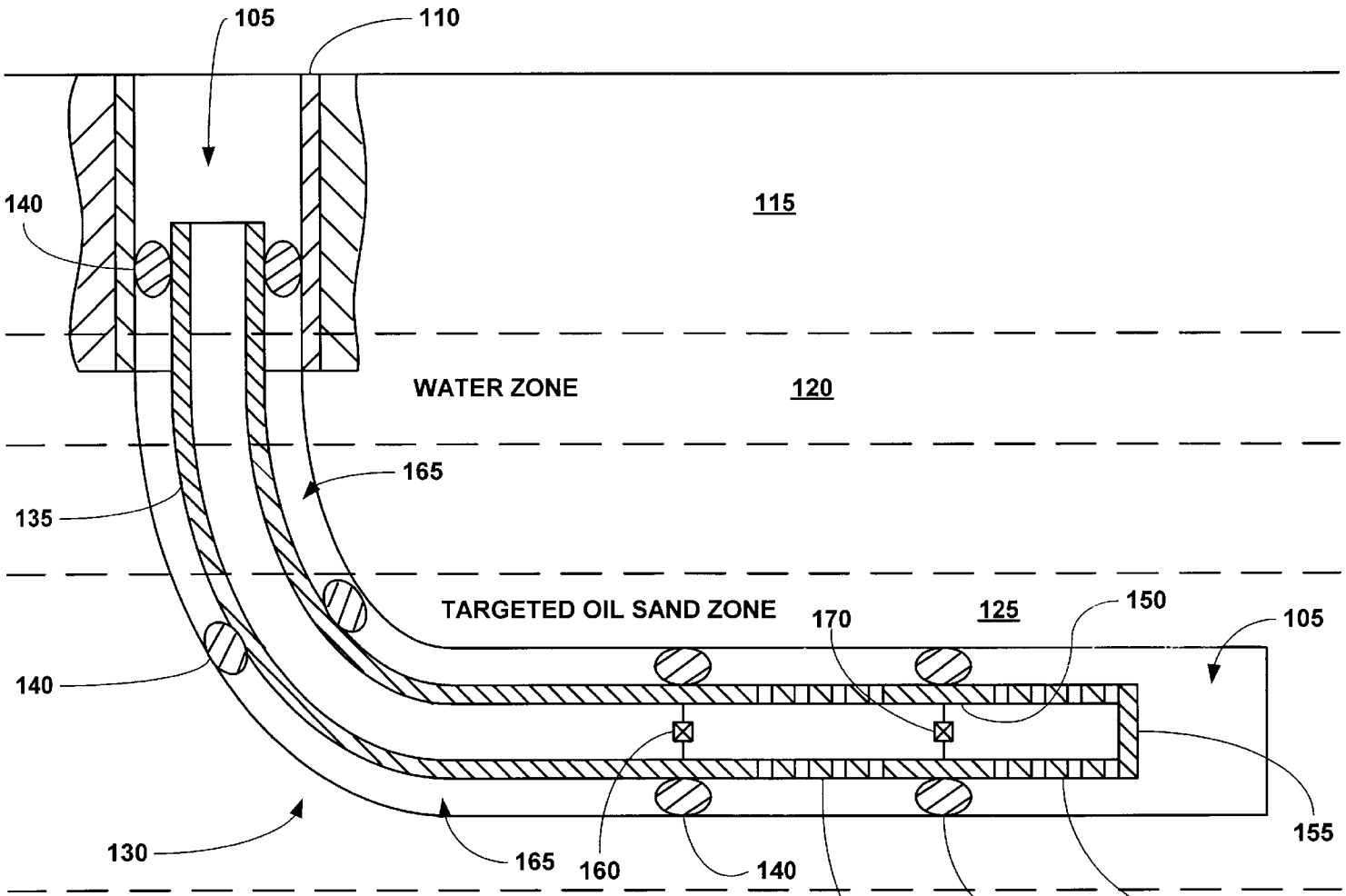
FIG. 1 is a fragmentary cross-sectional view illustrating the isolation of subterranean zones.

Referring to FIG. 1, a wellbore 105 including a casing 110 are positioned in a subterranean formation 115. The subterranean formation 115 includes a number of productive and non-productive zones, including a water zone 120 and a targeted oil sand zone 125. During exploration of the subterranean formation 115, the wellbore 105 may be extended in a well known manner to traverse the various productive and non-productive zones, including the water zone 120 and the targeted oil sand zone 125.

In a preferred embodiment, in order to fluidicly isolate the water zone 120 from the targeted oil sand zone 125, an apparatus 130 is provided that includes one or more sections of solid casing 135, one or more external seals 140, one or more sections of slotted casing 145, one or more intermediate sections of solid casing 150, and a solid shoe 155.

The solid casing 135 may provide a fluid conduit that transmits fluids and other materials from one end of the solid casing 135 to the other end of the solid casing 135. The solid casing 135 may comprise any number of conventional commercially available sections of solid tubular casing such as, for example, oilfield tubulars fabricated from chromium steel or fiberglass. In a preferred embodiment, the solid casing 135 comprises oilfield tubulars available from various foreign and domestic steel mills.

The solid casing 135 is preferably coupled to the casing 110. The solid casing 135 may be coupled to the casing 110 using any number of conventional commercially available processes such as, for example, welding, slotted and expandable connectors, or expandable solid connectors. In a preferred embodiment, the solid casing 135 is coupled to the casing 110 by using expandable solid connectors. The solid casing 135 may comprise a plurality of such solid casing 135.

The solid casing 135 is preferably coupled to one more of the slotted casings 145. The solid casing 135 may be coupled to the slotted casing 145 using any number of conventional commercially available processes such as, for example, welding, or slotted and expandable connectors. In a preferred embodiment, the solid casing 135 is coupled to the slotted casing 145 by expandable solid connectors.

In a preferred embodiment, the casing 135 includes one more valve members 160 for controlling the flow of fluids and other materials within the interior region of the casing 135. In an alternative embodiment, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the casing 135 is placed into the wellbore 105 by expanding the casing 135 in the radial direction into intimate contact with the interior walls of the wellbore 105. The casing 135 may be expanded in the radial direction using any number of conventional commercially available methods.

The seals 140 prevent the passage of fluids and other materials within the annular region 165 between the solid casings 135 and 150 and the wellbore 105. The seals 140 may comprise any number of conventional commercially available sealing materials suitable for sealing a casing in a wellbore such as, for example, lead, rubber or epoxy. In a preferred embodiment, the seals 140 comprise Stratalok epoxy material available from Halliburton Energy Services. The slotted casing 145 permits fluids and other materials to pass into and out of the interior of the slotted casing 145 from and to the annular region 165. In this manner, oil and gas may be produced from a producing subterranean zone within a subterranean formation. The slotted casing 145 may comprise any number of conventional commercially available sections of slotted tubular casing. In a preferred embodiment, the slotted casing 145 comprises expandable slotted tubular casing available from Petroline in Abeerdeen, Scotland. In a particularly preferred embodiment, the slotted casing 145 comprises expandable slotted sandscreen tubular casing available from Petroline in Abeerdeen, Scotland.

The slotted casing 145 is preferably coupled to one or more solid casing 135. The slotted casing 145 may be coupled to the solid casing 135 using any number of conventional commercially available processes such as, for example, welding, or slotted or solid expandable connectors. In a preferred embodiment, the slotted casing 145 is coupled to the solid casing 135 by expandable solid connectors.

The slotted casing 145 is preferably coupled to one or more intermediate solid casings 150. The slotted casing 145 may be coupled to the intermediate solid casing 150 using any number of conventional commercially available processes such as, for example, welding or expandable solid or slotted connectors. In a preferred embodiment, the slotted casing 145 is coupled to the intermediate solid casing 150 by expandable solid connectors.

The last slotted casing 145 is preferably coupled to the shoe 155. The last slotted casing 145 may be coupled to the shoe 155 using any number of conventional commercially available processes such as, for example, welding or expandable solid or slotted connectors. In a preferred embodiment, the last slotted casing 145 is coupled to the shoe 155 by an expandable solid connector.

In an alternative embodiment, the shoe 155 is coupled directly to the last one of the intermediate solid casings 150.

In a preferred embodiment, the slotted casings 145 are positioned within the wellbore 105 by expanding the slotted casings 145 in a radial direction into intimate contact with the interior walls of the wellbore 105. The slotted casings 145 may be expanded in a radial direction using any number of conventional commercially available processes.

The intermediate solid casing 150 permits fluids and other materials to pass between adjacent slotted casings 145. The intermediate solid casing 150 may comprise any number of conventional commercially available sections of solid tubular casing such as, for example, oilfield tubulars fabricated from chromium steel or fiberglass. In a preferred embodiment, the intermediate solid casing 150 comprises oilfield tubulars available from foreign and domestic steel mills.

The intermediate solid casing 150 is preferably coupled to one or more sections of the slotted casing 145. The intermediate solid casing 150 may be coupled to the slotted casing 145 using any number of conventional commercially available processes such as, for example, welding, or solid or slotted expandable connectors. In a preferred embodiment, the intermediate solid casing 150 is coupled to the slotted casing 145 by expandable solid connectors. The intermediate solid casing 150 may comprise a plurality of such intermediate solid casing 150.

In a preferred embodiment, the each intermediate solid casing 150 includes one more valve members 170 for controlling the flow of fluids and other materials within the interior region of the intermediate casing 150. In an alternative embodiment, as will be recognized by persons having ordinary skill in the art and the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

In a particularly preferred embodiment, the intermediate casing 150 is placed into the wellbore 105 by expanding the intermediate casing 150 in the radial direction into intimate contact with the interior walls of the wellbore 105. The intermediate casing 150 may be expanded in the radial direction using any number of conventional commercially available methods.

In an alternative embodiment, one or more of the intermediate solid casings 150 may be omitted. In an alternative preferred embodiment, one or more of the slotted casings 145 are provided with one or more seals 140.

The shoe 155 provides a support member for the apparatus 130. In this manner, various production and exploration tools may be supported by the show 150. The shoe 150 may comprise any number of conventional commercially available shoes suitable for use in a wellbore such as, for example, cement filled shoe, or an aluminum or composite shoe. In a preferred embodiment, the shoe 150 comprises an aluminum shoe available from Halliburton. In a preferred embodiment, the shoe 155 is selected to provide sufficient strength in compression and tension to permit the use of high capacity production and exploration tools.

In a particularly preferred embodiment, the apparatus 130 includes a plurality of solid casings 135, a plurality of seals 140, a plurality of slotted casings 145, a plurality of intermediate solid casings 150, and a shoe 155. More generally, the apparatus 130 may comprise one or more solid casings 135, each with one or more valve members 160, n slotted casings 145, n−1 intermediate solid casings 150, each with one or more valve members 170, and a shoe 155.

During operation of the apparatus 130, oil and gas may be controllably produced from the targeted oil sand zone 125 using the slotted casings 145. The oil and gas may then be transported to a surface location using the solid casing 135. The use of intermediate solid casings 150 with valve members 170 permits isolated sections of the zone 125 to be selectively isolated for production. The seals 140 permit the zone 125 to be fluidicly isolated from the zone 120. The seals 140 further permits isolated sections of the zone 125 to be fluidicly isolated from each other. In this manner, the apparatus 130 permits unwanted and/or non-productive subterranean zones to be fluidicly isolated.

In an alternative embodiment, as will be recognized by persons having ordinary skill in the art and also having the benefit of the present disclosure, during the production mode of operation, an internal tubular string with various arrangements of packers, perforated tubing, sliding sleeves, and valves may be employed within the apparatus to provide various options for commingling and isolating subterranean zones from each other while providing a fluid path to the surface.

Referring to FIGS. 2*a*–2*d*, an illustrative embodiment of a system 200 for isolating subterranean formations includes a tubular support member 202 that defines a passage 202*a*. A tubular expansion cone 204 that defines a passage 204*a* is coupled to an end of the tubular support member 202. In an exemplary embodiment, the tubular expansion cone 204 includes a tapered outer surface 204*b* for reasons to be described.

A pre-expanded end 206*a* of a first expandable tubular member 206 that defines a passage 206*b* is adapted to mate with and be supported by the tapered outer surface 204*b* of the tubular expansion cone 204. The first expandable tubular member 206 further includes an unexpanded intermediate portion 206*c*, another pre-expanded end 206*d*, and a sealing member 206*e* coupled to the exterior surface of the unexpanded intermediate portion. In an exemplary embodiment, the inside and outside diameters of the pre-expanded ends, 206*a* and 206*d*, of the first expandable tubular member 206 are greater than the inside and outside diameters of the unexpanded intermediate portion 206*c*. An end 208*a* of a shoe 208 is coupled to the pre-expanded end 206*a* of the first expandable tubular member 206 by a conventional threaded connection.

An end 210*a* of a slotted tubular member 210 that defines a passage 210*b* is coupled to the other pre-expanded end 206*d* of the first expandable tubular member 206 by a conventional threaded connection. Another end 210*c* of the slotted tubular member 210 is coupled to an end 212*a* of a slotted tubular member 212 that defines a passage 212*b* by a conventional threaded connection. A pre-expanded end 214*a* of a second expandable tubular member 214 that defines a passage 214*b* is coupled to the other end 212*c* of the tubular member 212. The second expandable tubular member 214 further includes an unexpanded intermediate portion 214*c*, another pre-expanded end 214*d*, and a sealing member 214*e* coupled to the exterior surface of the unexpanded intermediate portion. In an exemplary embodiment, the inside and outside diameters of the pre-expanded ends, 214*a* and 214*d*, of the second expandable tubular member 214 are greater than the inside and outside diameters of the unexpanded intermediate portion 214*c*.

An end 216*a* of a slotted tubular member 216 that defines a passage 216*b* is coupled to the other pre-expanded end 214*d* of the second expandable tubular member 214 by a conventional threaded connection. Another end 216*c* of the slotted tubular member 216 is coupled to an end 218*a* of a slotted tubular member 218 that defines a passage 218*b* by a conventional threaded connection. A pre-expanded end 220*a* of a third expandable tubular member 220 that defines a passage 220*b* is coupled to the other end 218*c* of the slotted tubular member 218. The third expandable tubular member 220 further includes an unexpanded intermediate portion 220*c*, another pre-expanded end 220*d*, and a sealing member 220*e* coupled to the exterior surface of the unexpanded intermediate portion. In an exemplary embodiment, the inside and outside diameters of the pre-expanded ends, 220*a* and 220*d*, of the third expandable tubular member 220 are greater than the inside and outside diameters of the unexpanded intermediate portion 220*c*.

An end 222*a* of a tubular member 222 is threadably coupled to the end 30*d* of the third expandable tubular member 220.

In an exemplary embodiment, the inside and outside diameters of the pre-expanded ends, 206*a*, 206*d*, 214*a*, 214*d*, 220*a* and 220*d*, of the expandable tubular members, 206, 214, and 220, and the slotted tubular members 210, 212, 216, and 218, are substantially equal. In several exemplary embodiments, the sealing members, 206*e*, 214*e*, and 220*e*, of the expandable tubular members, 206, 214, and 220, respectively, further include anchoring elements for engaging the wellbore casing 104. In several exemplary embodiments, the slotted tubular members, 210, 212, 216, and 218, are conventional slotted tubular members having threaded end connections suitable for use in an oil or gas well, an underground pipeline, or as a structural support. In several alternative embodiments, the slotted tubular members, 210, 212, 216, and 218 are conventional slotted tubular members for recovering or introducing fluidic materials such as, for example, oil, gas and/or water from or into a subterranean formation.

Figure 2A:
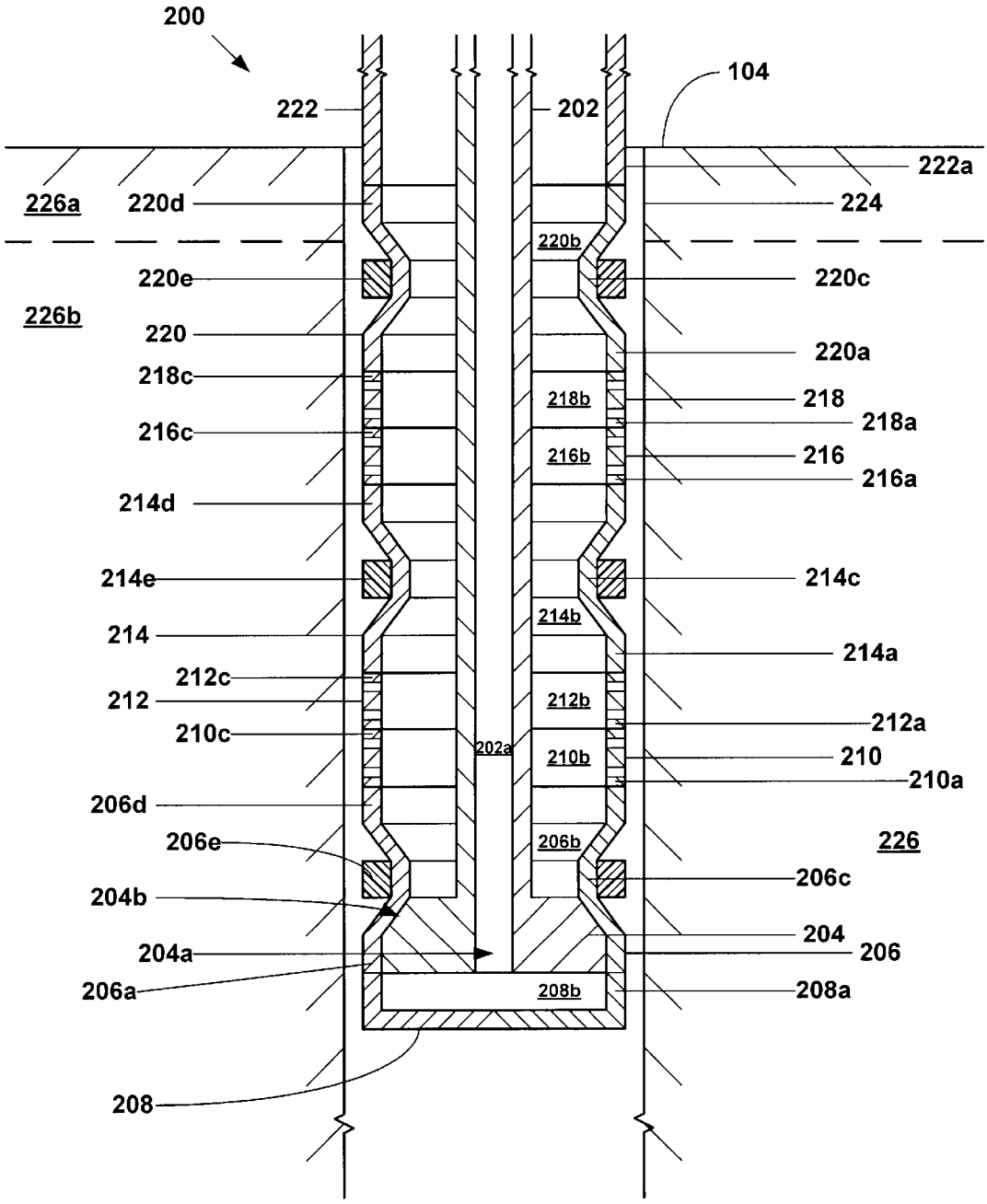
FIG. 2*a* is a cross sectional illustration of the placement of an illustrative embodiment of a system for isolating subterranean zones within a borehole.

In an exemplary embodiment, as illustrated in FIG. 2*a*, the system 200 is initially positioned in a borehole 224 formed in a subterranean formation 226 that includes a water zone 226*a* and a targeted oil sand zone 226*b*. The borehole 224 may be positioned in any orientation from vertical to horizontal. In an exemplary embodiment, the upper end of the tubular support member 202 may be supported in a conventional manner using, for example, a slip joint, or equivalent device in order to permit upward movement of the tubular support member and tubular expansion cone 204 relative to one or more of the expandable tubular members, 206, 214, and 220, and tubular members, 210, 212, 216, and 218.

Figure 2B:
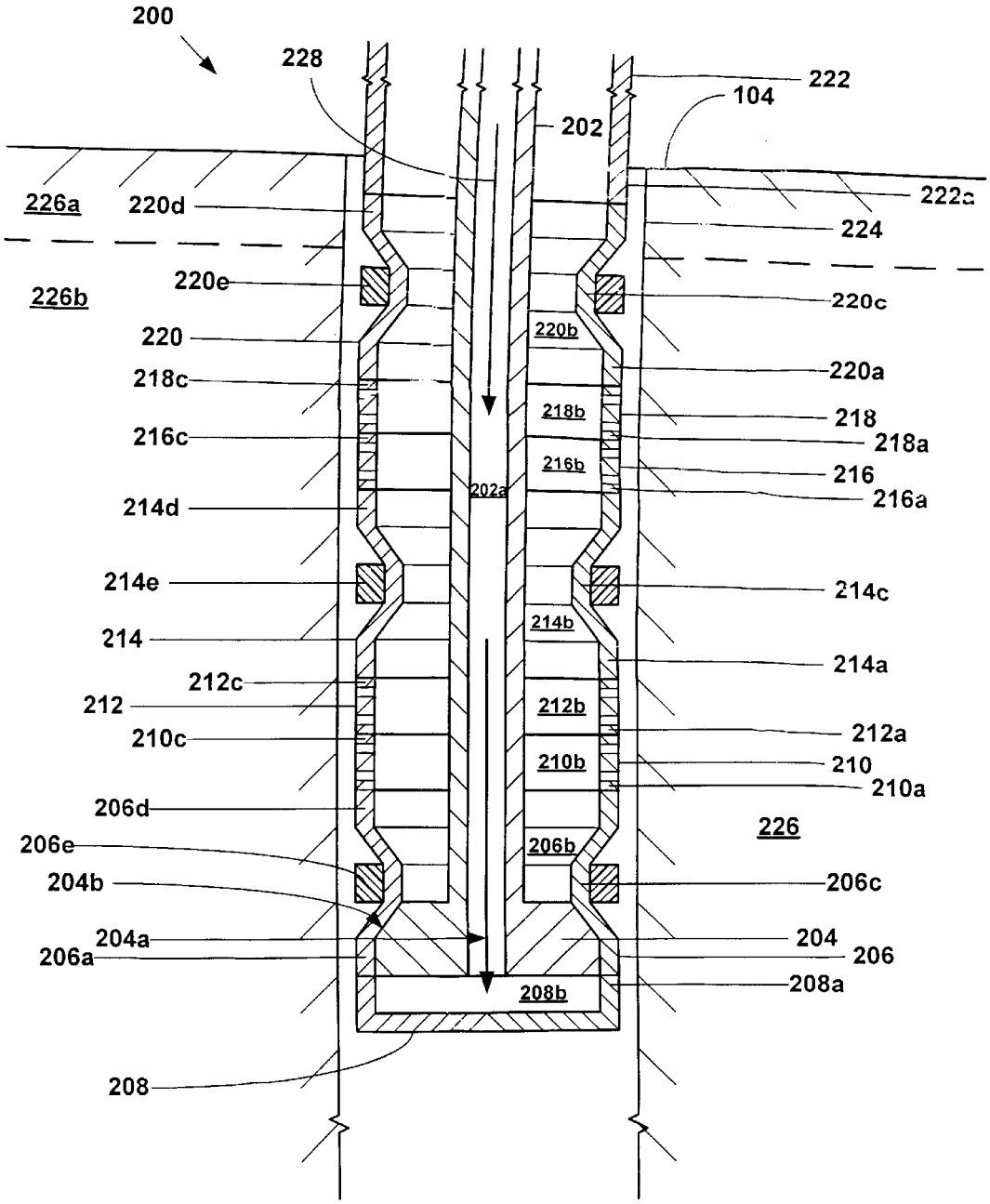
FIG. 2*b* is a cross sectional illustration of the system of FIG. 2*a* during the injection of a fluidic material into the tubular support member.

In an exemplary embodiment, as illustrated in FIG. 2*b*, a fluidic material 228 is then injected into the system 200, through the passages, 202*a* and 204*a*, of the tubular support member 202 and tubular expansion cone 204, respectively.

Figure 2C:
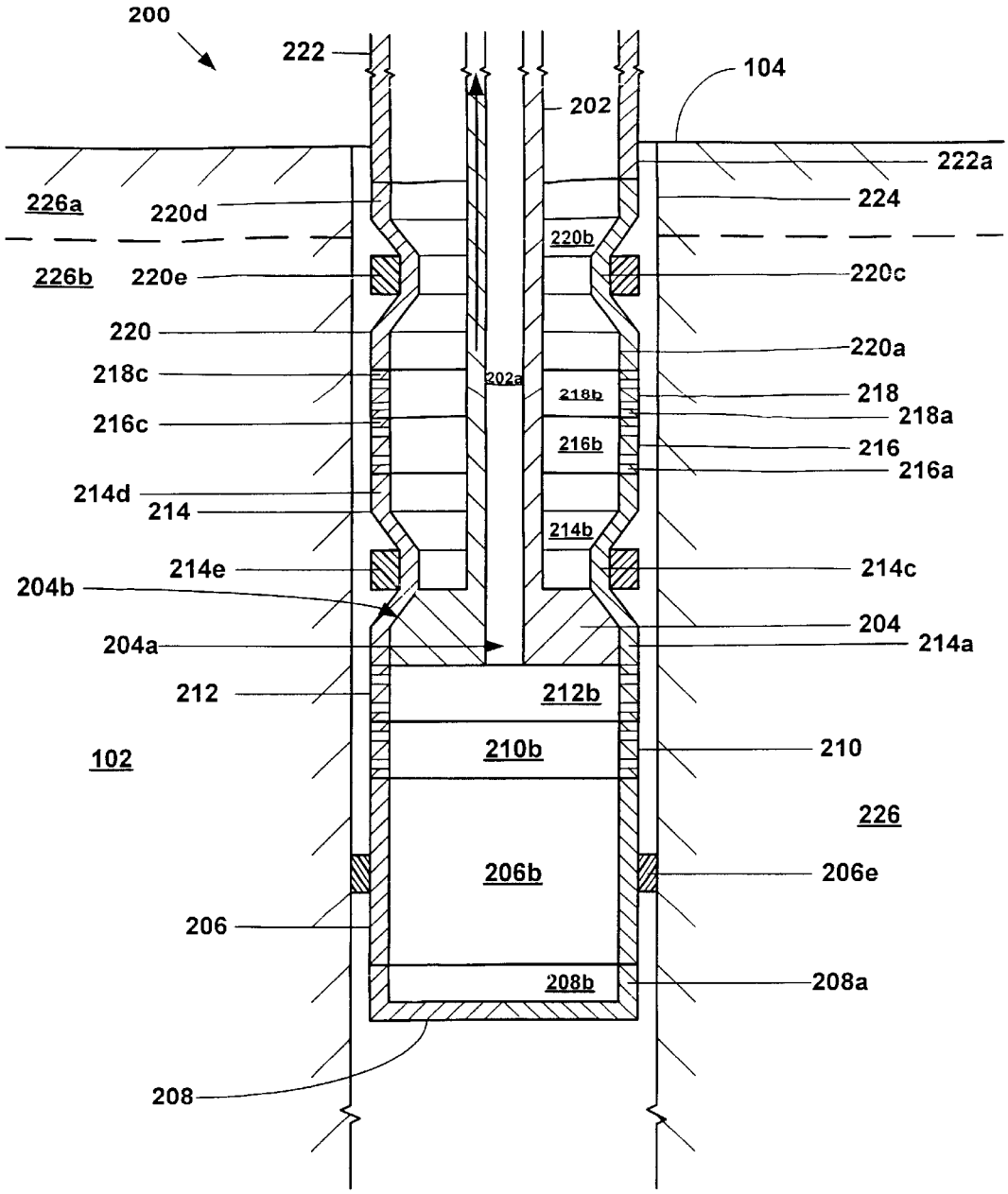
FIG. 2*c* is a cross sectional illustration of the system of FIG. 2*b* while pulling the tubular expansion cone out of the wellbore.

In an exemplary embodiment, as illustrated in FIG. 2*c*, the continued injection of the fluidic material 228 through the passages, 202*a* and 204*a*, of the tubular support member 202 and the tubular expansion cone 204, respectively, pressurizes the passage 18*b* of the shoe 18 below the tubular expansion cone thereby radially expanding and plastically deforming the expandable tubular member 206 off of the tapered external surface 204*b* of the tubular expansion cone 204. In particular, the intermediate non pre-expanded portion 206*c* of the expandable tubular member 206 is radially expanded and plastically deformed off of the tapered external surface 204*b* of the tubular expansion cone 204. As a result, the sealing member 206*e* engages the interior surface of the wellbore casing 104. Consequently, the radially expanded intermediate portion 206*c* of the expandable tubular member 206 is thereby coupled to the wellbore casing 104. In an exemplary embodiment, the radially expanded intermediate portion 206*c* of the expandable tubular member 206 is also thereby anchored to the wellbore casing 104.

Figure 2D:
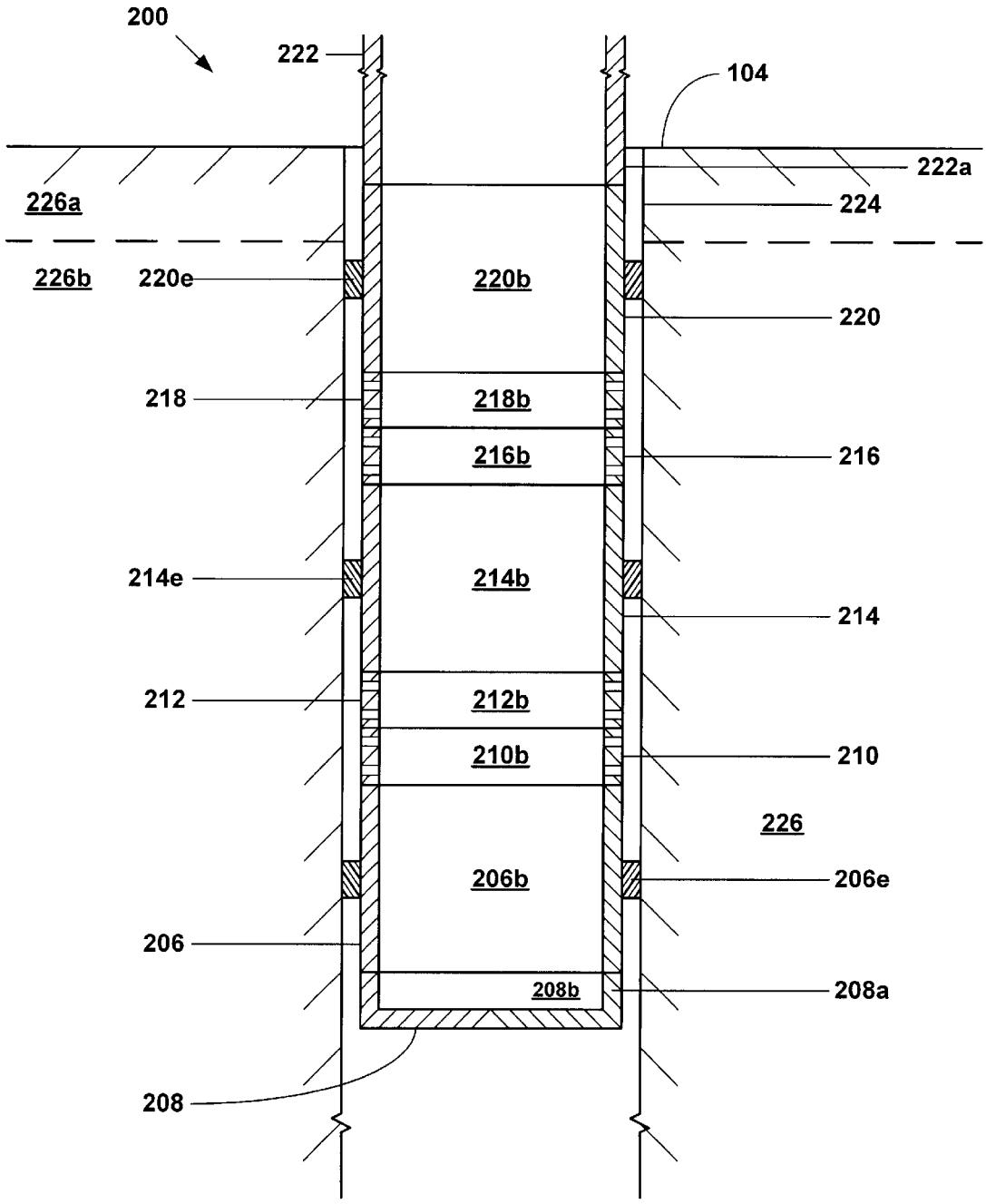
FIG. 2*d* is a cross sectional illustration of the system of FIG. 2*c* after the tubular expansion cone has been completely pulled out of the wellbore.

In an exemplary embodiment, as illustrated in FIG. 2*d*, after the expandable tubular member 206 has been plastically deformed and radially expanded off of the tapered external surface 204*b* of the tubular expansion cone 204, the tubular expansion cone is pulled out of the borehole 224 by applying an upward force to the tubular support member 202. As a result, the second and third expandable tubular members, 214 and 220, are radially expanded and plastically deformed off of the tapered external surface 204*b* of the tubular expansion cone 204. In particular, the intermediate non pre-expanded portion 214*c* of the second expandable tubular member 214 is radially expanded and plastically deformed off of the tapered external surface 204*b* of the tubular expansion cone 204. As a result, the sealing member 214*e* engages the interior surface of the wellbore 224. Consequently, the radially expanded intermediate portion 214*c* of the second expandable tubular member 214 is thereby coupled to the wellbore 224. In an exemplary embodiment, the radially expanded intermediate portion 214*c* of the second expandable tubular member 214 is also thereby anchored to the wellbore 104. Furthermore, the continued application of the upward force to the tubular member 202 will then displace the tubular expansion cone 204 upwardly into engagement with the pre-expanded end 220*a* of the third expandable tubular member 220. Finally, the continued application of the upward force to the tubular member 202 will then radially expand and plastically deform the third expandable tubular member 220 off of the tapered external surface 204*b* of the tubular expansion cone 204. In particular, the intermediate non pre-expanded portion 220*c* of the third expandable tubular member 220 is radially expanded and plastically deformed off of the tapered external surface 204*b* of the tubular expansion cone 204. As a result, the sealing member 220*e* engages the interior surface of the wellbore 224. Consequently, the radially expanded intermediate portion 220*c* of the third expandable tubular member 220 is thereby coupled to the wellbore 224. In an exemplary embodiment, the radially expanded intermediate portion 220*c* of the third expandable tubular member 220 is also thereby anchored to the wellbore 224. As a result, the water zone 226*a* and fluidicly isolated from the targeted oil sand zone 226*b*.

After completing the radial expansion and plastic deformation of the third expandable tubular member 220, the tubular support member 202 and the tubular expansion cone 204 are removed from the wellbore 224.

Thus, during the operation of the system 10, the intermediate non pre-expanded portions, 206*c*, 214*c*, and 220*c*, of the expandable tubular members, 206, 214, and 220, respectively, are radially expanded and plastically deformed by the upward displacement of the tubular expansion cone 204. As a result, the sealing members, 206*e*, 214*e*, and 220*e*, are displaced in the radial direction into engagement with the wellbore 224 thereby coupling the shoe 208, the expandable tubular member 206, the slotted tubular members, 210 and 212, the expandable tubular member 214, the slotted tubular members, 216 and 218, and the expandable tubular member 220 to the wellbore. Furthermore, as a result, the connections between the expandable tubular members, 206, 214, and 220, the shoe 208, and the slotted tubular members, 210, 212, 216, and 218, do not have to be expandable connections thereby providing significant cost savings. In addition, the inside diameters of the expandable tubular members, 206, 214, and 220, and the slotted tubular members, 210, 212, 216, and 218, after the radial expansion process, are substantially equal. In this manner, additional conventional tools and other conventional equipment may be easily positioned within, and moved through, the expandable and slotted tubular members. In several alternative embodiments, the conventional tools and equipment include conventional valving and other conventional flow control devices for controlling the flow of fluidic materials within and between the expandable tubular members, 206, 214, and 220, and the slotted tubular members, 210, 212, 216, and 218.

Furthermore, in the system 200, the slotted tubular members 210, 212, 216, and 218 are interleaved among the expandable tubular members, 206, 214, and 220. As a result, because only the intermediate non pre-expanded portions, 206*c*, 214*c*, and 220*c*, of the expandable tubular members, 206, 214, and 220, respectively, are radially expanded and plastically deformed, the slotted tubular members, 210, 212, 216, and 218 can be conventional slotted tubular members thereby significantly reducing the cost and complexity of the system 10. Moreover, because only the intermediate non pre-expanded portions, 206*c*, 214*c*, and 220*c*, of the expandable tubular members, 206, 214, and 220, respectively, are radially expanded and plastically deformed, the number and length of the interleaved slotted tubular members, 210, 212, 216, and 218 can be much greater than the number and length of the expandable tubular members. In an exemplary embodiment, the total length of the intermediate non pre-expanded portions, 206*c*, 214*c*, and 220*c*, of the expandable tubular members, 206, 214, and 220, is approximately 200 feet, and the total length of the slotted tubular members, 210, 212, 216, and 218, is approximately 3800 feet. Consequently, in an exemplary embodiment, a system 200 having a total length of approximately 4000 feet is coupled to the wellbore 224 by radially expanding and plastically deforming a total length of only approximately 200 feet.

Furthermore, the sealing members 206*e*, 214*e*, and 220*e*, of the expandable tubular members, 206, 214, and 220, respectively, are used to couple the expandable tubular members and the slotted tubular members, 210, 212, 216, and 218 to the wellbore 224, the radial gap between the slotted tubular members, the expandable tubular members, and the wellbore 224 may be large enough to effectively eliminate the possibility of damage to the expandable tubular members and slotted tubular members during the placement of the system 200 within the wellbore.

In an exemplary embodiment, the pre-expanded ends, 206*a*, 206*d*, 214*a*, 214*d*, 220*a*, and 220*d*, of the expandable tubular members, 206, 214, and 220, respectively, and the slotted tubular members, 210, 212, 216, and 218, have outside diameters and wall thicknesses of 8.375 inches and 0.350 inches, respectively; prior to the radial expansion, the intermediate non pre-expanded portions, 206*c*, 214*c*, and 220*c*, of the expandable tubular members, 206, 214, and 220, respectively, have outside diameters of 7.625 inches; the slotted tubular members, 210, 212, 216, and 218, have inside diameters of 7.675 inches; after the radial expansion, the inside diameters of the intermediate portions, 206*c*, 214*c*, and 220*c*, of the expandable tubular members, 206, 214, and 220, are equal to 7.675 inches; and the wellbore 224 has an inside diameter of 8.755 inches.

In an exemplary embodiment, the pre-expanded ends, 206*a*, 206*d*, 214*a*, 214*d*, 220*a*, and 220*d*, of the expandable tubular members, 206, 214, and 220, respectively, and the slotted tubular members, 210, 212, 216, and 218, have outside diameters and wall thicknesses of 4.500 inches and 0.250 inches, respectively; prior to the radial expansion, the intermediate non pre-expanded portions, 206*c*, 214*c*, and 220*c*, of the expandable tubular members, 206, 214, and 220, respectively, have outside diameters of 4.000 inches; the slotted tubular members, 210, 212, 216, and 218, have inside diameters of 4.000 inches; after the radial expansion, the inside diameters of the intermediate portions, 206*c*, 214*c*, and 220*c*, of the expandable tubular members, 206, 214, and 220, are equal to 4.000 inches; and the wellbore 224 has an inside diameter of 4.892 inches.

In an exemplary embodiment, the system 200 is used to inject or extract fluidic materials such as, for example, oil, gas, and/or water into or from the subterranean formation 226*b*.

Figure 3:
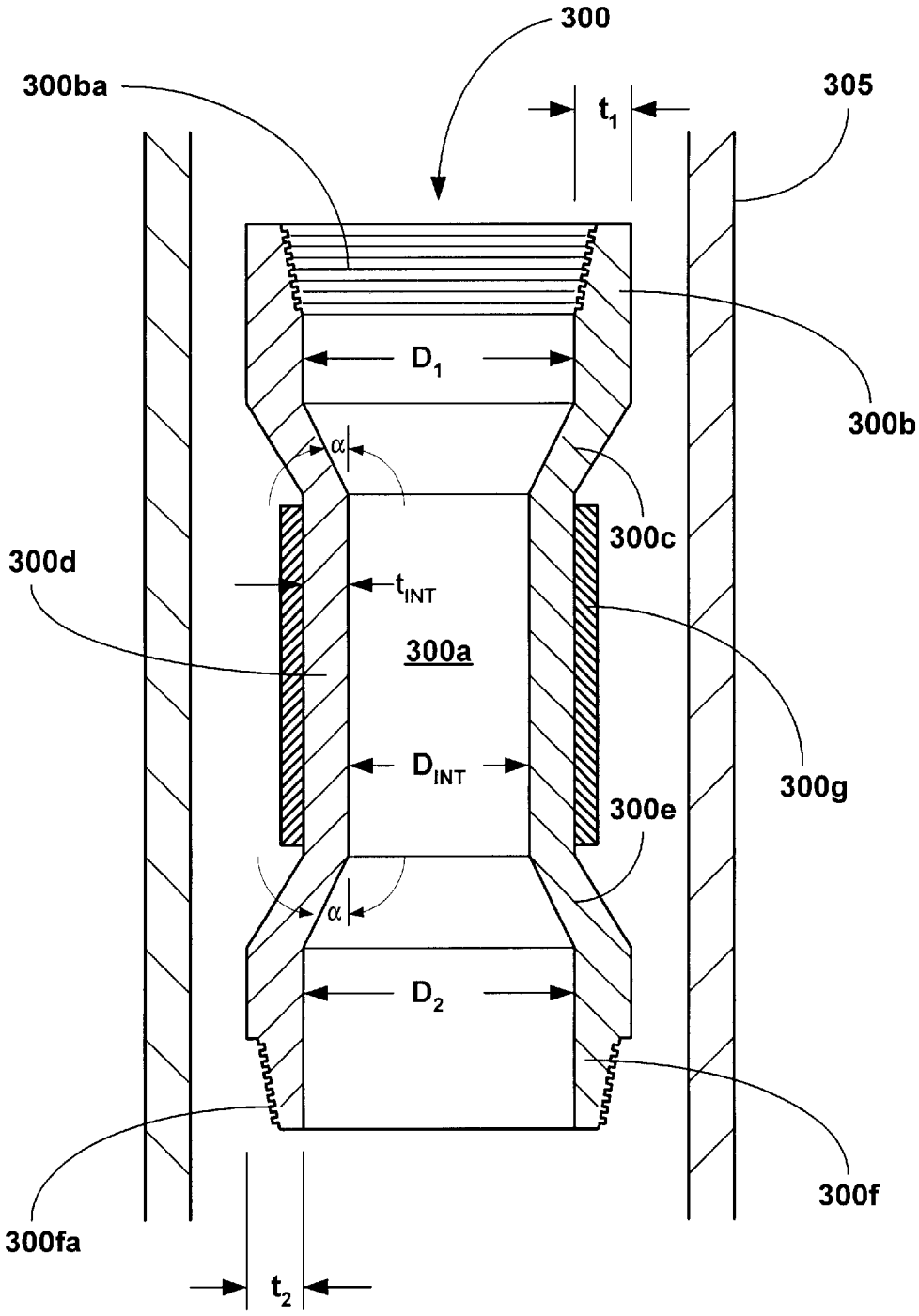
FIG. 3 is a cross sectional illustration of an illustrative embodiment of the expandable tubular members of the system of FIG. 2*a*.
Figure 4:
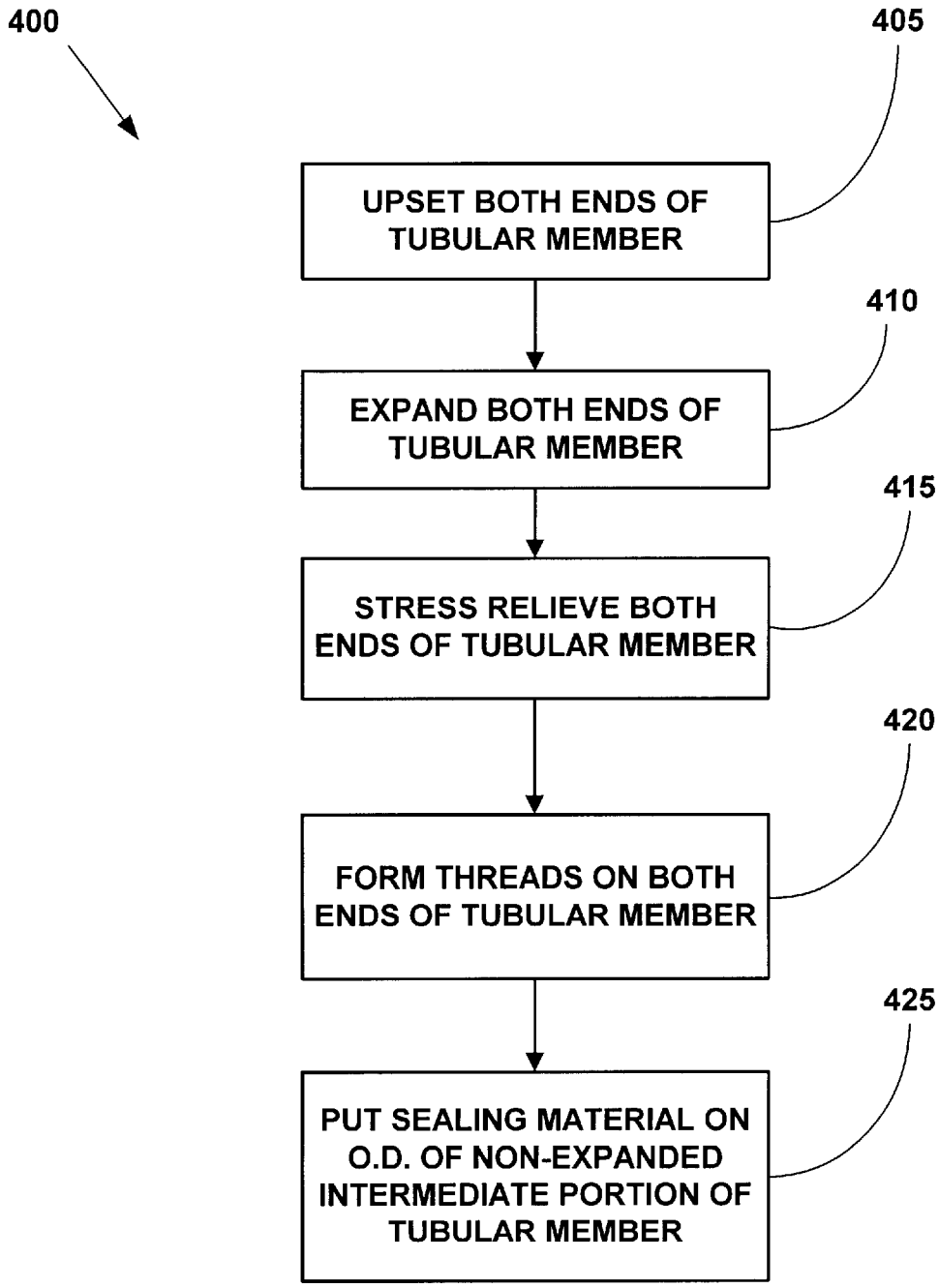
FIG. 4 is a flow chart illustration of an illustrative embodiment of a method for manufacturing the expandable tubular member of FIG. 3.

Referring now to FIG. 3, an exemplary embodiment of an expandable tubular member 300 will now be described. The tubular member 300 defines an interior region 300*a* and includes a first end 300*b* including a first threaded connection 300*ba*, a first tapered portion 300*c*, an intermediate portion 300*d*, a second tapered portion 300*e*, and a second end 300*f* including a second threaded connection 300*fa*. The tubular member 300 further preferably includes an intermediate sealing member 300*g* that is coupled to the exterior surface of the intermediate portion 300*d*.

In an exemplary embodiment, the tubular member 300 has a substantially annular cross section. The tubular member 300 may be fabricated from any number of conventional commercially available materials such as, for example, Oilfield Country Tubular Goods (OCTG), 13 chromium steel tubing/casing, or L83, J55, or P110 API casing.

In an exemplary embodiment, the interior 300*a* of the tubular member 300 has a substantially circular cross section. Furthermore, in an exemplary embodiment, the interior region 300*a* of the tubular member includes a first inside diameter $D_1$, an intermediate inside diameter $D_{INT}$, and a second inside diameter $D_2$. In an exemplary embodiment, the first and second inside diameters, $D_1$ and $D_2$, are substantially equal. In an exemplary embodiment, the first and second inside diameters, $D_1$ and $D_2$, are greater than the intermediate inside diameter $D_{INT}$.

The first end 300*b* of the tubular member 300 is coupled to the intermediate portion 300*d* by the first tapered portion 300*c*, and the second end 300*f* of the tubular member is coupled to the intermediate portion by the second tapered portion 300*e*. In an exemplary embodiment, the outside diameters of the first and second ends, 300*b* and 300*f*, of the tubular member 300 is greater than the outside diameter of the intermediate portion 300*d* of the tubular member. The first and second ends, 300*b* and 300*f*, of the tubular member 300 include wall thicknesses, $t_1$ and $t_2$, respectively. In an exemplary embodiment, the outside diameter of the intermediate portion 300*d* of the tubular member 300 ranges from about 75% to 98% of the outside diameters of the first and second ends, 300*a* and 300*f*. The intermediate portion 300*d* of the tubular member 300 includes a wall thickness $t_{INT}$.

In an exemplary embodiment, the wall thicknesses $t_1$ and $t_2$ are substantially equal in order to provide substantially equal burst strength for the first and second ends, 300*a* and 300*f*, of the tubular member 300. In an exemplary embodiment, the wall thicknesses, $t_1$ and $t_2$, are both greater than the wall thickness $t_{INT}$ in order to optimally match the burst strength of the first and second ends, 300*a* and 300*f*, of the tubular member 300 with the intermediate portion 300*d* of the tubular member 300.

In an exemplary embodiment, the first and second tapered portions, 300*c* and 300*e*, are inclined at an angle, $\alpha$, relative to the longitudinal direction ranging from about 0 to 30 degrees in order to optimally facilitate the radial expansion of the tubular member 300. In an exemplary embodiment, the first and second tapered portions, 300*c* and 300*e*, provide a smooth transition between the first and second ends, 300*a* and 300*f*, and the intermediate portion 300*d*, of the tubular member 300 in order to minimize stress concentrations.

The intermediate sealing member 300*g* is coupled to the outer surface of the intermediate portion 300*d* of the tubular member 300. In an exemplary embodiment, the intermediate sealing member 300*g* seals the interface between the intermediate portion 300*d* of the tubular member 300 and the interior surface of a wellbore casing 305, or other preexisting structure, after the radial expansion and plastic deformation of the intermediate portion 300*d* of the tubular member 300. In an exemplary embodiment, the intermediate sealing member 300*g* has a substantially annular cross section. In an exemplary embodiment, the outside diameter of the intermediate sealing member 300*g* is selected to be less than the outside diameters of the first and second ends, 300*a* and 300*f*, of the tubular member 300 in order to optimally protect the intermediate sealing member 300*g* during placement of the tubular member 300 within the wellbore casings 305. The intermediate sealing member 300*g* may be fabricated from any number of conventional commercially available materials such as, for example, thermoset or thermoplastic polymers. In an exemplary embodiment, the intermediate sealing member 300*g* is fabricated from thermoset polymers in order to optimally seal the radially expanded intermediate portion 300*d* of the tubular member 300 with the wellbore casing 305. In several alternative embodiments, the sealing member 300*g* includes one or more rigid anchors for engaging the wellbore casing 305 to thereby anchor the radially expanded and plastically deformed intermediate portion 300*d* of the tubular member 300 to the wellbore casing.

Referring to FIGS. 4, and 5*a* to 5*d*, in an exemplary embodiment, the tubular member 300 is formed by a process 400 that includes the steps of: (1) upsetting both ends of a tubular member in step 405; (2) expanding both upset ends of the tubular member in step 410; (3) stress relieving both expanded upset ends of the tubular member in step 415; (4) forming threaded connections in both expanded upset ends of the tubular member in step 420; and (5) putting a sealing material on the outside diameter of the non-expanded intermediate portion of the tubular member in step 425.

Figure 5A:
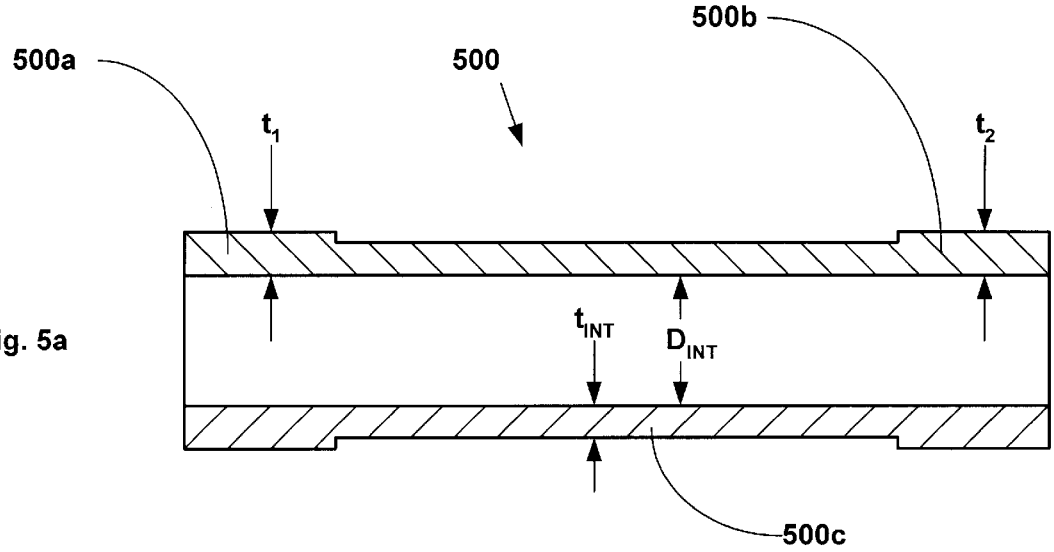
FIG. 5*a* is a cross sectional illustration of an illustrative embodiment of the upsetting of the ends of a tubular member.

As illustrated in FIG. 5*a*, in step 405, both ends, 500*a* and 500*b*, of a tubular member 500 are upset using conventional upsetting methods. The upset ends, 500*a* and 500*b*, of the tubular member 500 include the wall thicknesses $t_1$ and $t_2$. The intermediate portion 500*c* of the tubular member 500 includes the wall thickness $t_{INT}$ and the interior diameter $D_{INT}$. In an exemplary embodiment, the wall thicknesses $t_1$ and $t_2$ are substantially equal in order to provide burst strength that is substantially equal along the entire length of the tubular member 500. In an exemplary embodiment, the wall thicknesses $t_1$ and $t_2$ are both greater than the wall thickness $t_{INT}$ in order to provide burst strength that is substantially equal along the entire length of the tubular member 500, and also to optimally facilitate the formation of threaded connections in the first and second ends, 500*a* and 500*b*.

Figure 5B:
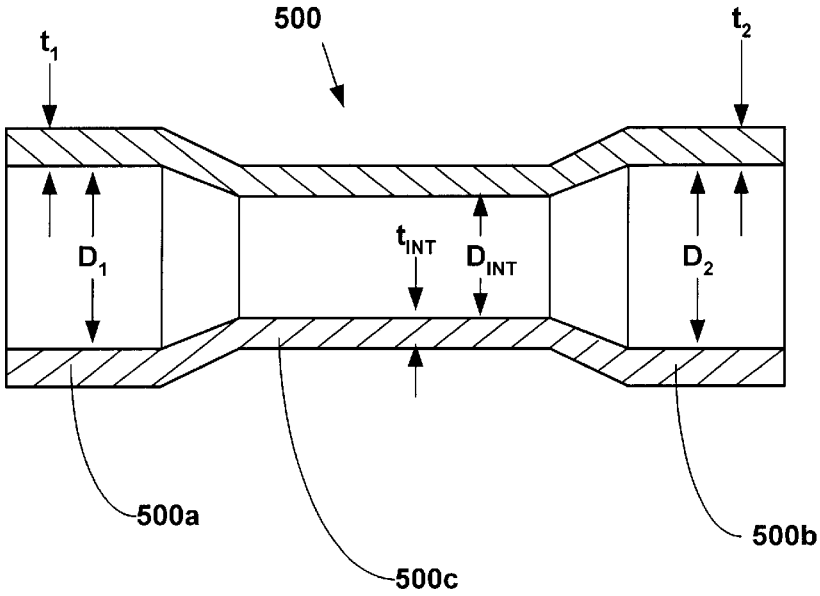
FIG. 5*b* is a cross sectional illustration of the expandable tubular member of FIG. 5*a* after radially expanding and plastically deforming the ends of the expandable tubular member.

As illustrated in FIG. 5*b*, in steps 410 and 415, both ends, 500*a* and 500*b*, of the tubular member 500 are radially expanded using conventional radial expansion methods, and then both ends, 500*a* and 500*b*, of the tubular member are stress relieved. The radially expanded ends, 500*a* and 500*b*, of the tubular member 500 include the interior diameters $D_1$ and $D_2$. In an exemplary embodiment, the interior diameters $D_1$ and $D_2$ are substantially equal in order to provide a burst strength that is substantially equal. In an exemplary embodiment, the ratio of the interior diameters $D_1$ and $D_2$ to the interior diameter $D_{INT}$ ranges from about 100% to 120% in order to facilitate the subsequent radial expansion of the tubular member 500.

In a preferred embodiment, the relationship between the wall thicknesses $t_1$, $t_2$, and $t_{INT}$ of the tubular member 500; the inside diameters $D_1$, $D_2$ and $D_{INT}$ of the tubular member 500; the inside diameter $D_{wellbore}$ of the wellbore casing, or other structure, that the tubular member 500 will be inserted into; and the outside diameter $D_{cone}$ of the expansion cone that will be used to radially expand the tubular member 500 within the wellbore casing is given by the following expression:

$$Dwellbore - 2 * t_1 \geq D_1 \geq \frac{1}{t_1}[(t_1 - t_{INT}) * D_{cone} + t_{INT} * D_{INT}] \quad (1)$$

where $t_1 = t_2$; and $D_1 = D_2$.

By satisfying the relationship given in equation (1), the expansion forces placed upon the tubular member 500 during the subsequent radial expansion process are substantially equalized. More generally, the relationship given in equation (1) may be used to calculate the optimal geometry for the tubular member 500 for subsequent radial expansion and plastic deformation of the tubular member 500 for fabricating and/or repairing a wellbore casing, a pipeline, or a structural support.

Figure 5C:
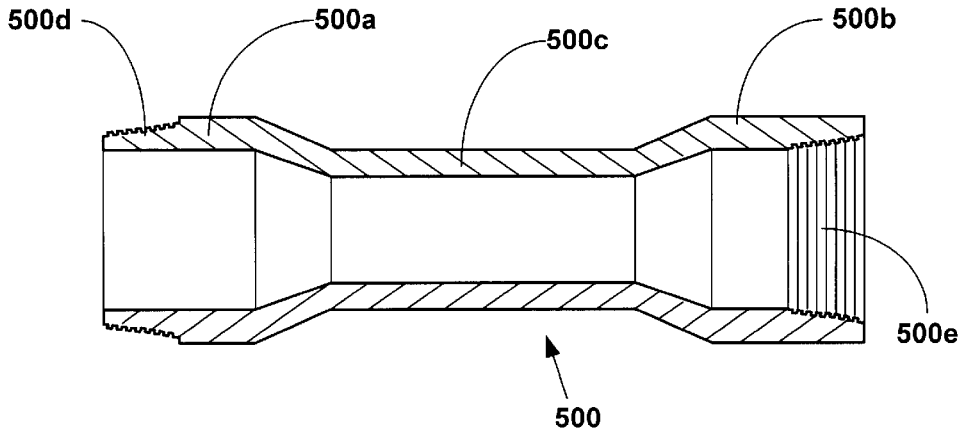
FIG. 5*c* is a cross sectional illustration of the expandable tubular member of FIG. 5*b* after forming threaded connections on the ends of the expandable tubular member.

As illustrated in FIG. 5*c*, in step 420, conventional threaded connections, 500*d* and 500*e*, are formed in both expanded ends, 500*a* and 500*b*, of the tubular member 500. In an exemplary embodiment, the threaded connections, 500*d* and 500*e*, are provided using conventional processes for forming pin and box type threaded connections available from Atlas-Bradford.

Figure 5D:
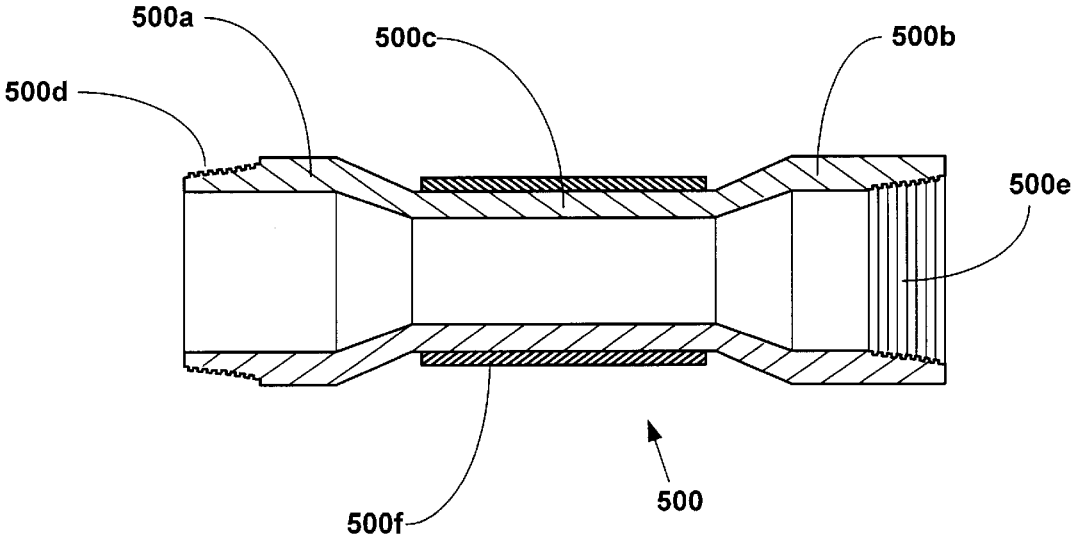
FIG. 5*d* is a cross sectional illustration of the expandable tubular member of FIG. 5*c* after coupling sealing members to the exterior surface of the intermediate unexpanded portion of the expandable tubular member.

As illustrated in FIG. 5*d*, in step 425, a sealing member 500*f* is then applied onto the outside diameter of the non-expanded intermediate portion 500*c* of the tubular member 500. The sealing member 500*f* may be applied to the outside diameter of the non-expanded intermediate portion 500*c* of the tubular member 500 using any number of conventional commercially available methods. In a preferred embodiment, the sealing member 500*f* is applied to the outside diameter of the intermediate portion 500*c* of the tubular member 500 using commercially available chemical and temperature resistant adhesive bonding.

In an exemplary embodiment, the expandable tubular members, 206, 214, and 220, of the system 200 are substantially identical to, and/or incorporate one or more of the teachings of, the tubular members 300 and 500.

Figure 6:
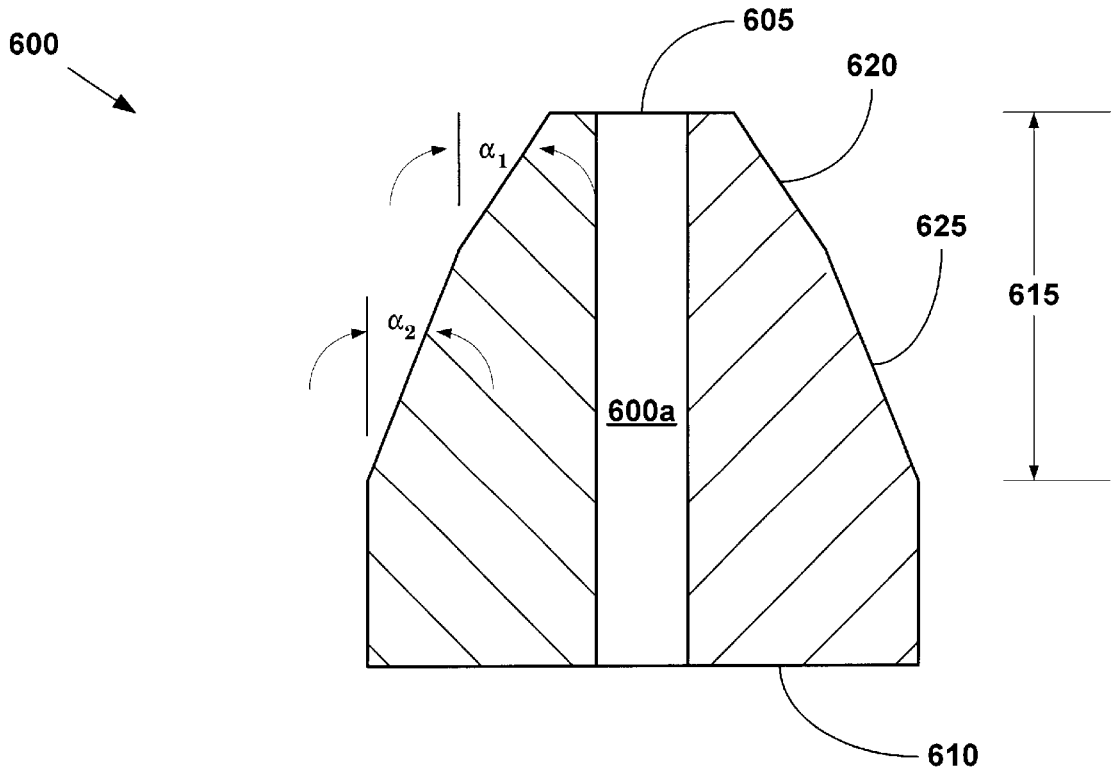
FIG. 6 is a cross-sectional illustration of an exemplary embodiment of a tubular expansion cone.

Referring to FIG. 6, an exemplary embodiment of tubular expansion cone 600 for radially expanding the tubular members 206, 214, 220, 300 and 500 will now be described. The expansion cone 600 defines a passage 600*a* and includes a front end 605, a rear end 610, and a radial expansion section 615.

In an exemplary embodiment, the radial expansion section 615 includes a first conical outer surface 620 and a second conical outer surface 625. The first conical outer surface 620 includes an angle of attack $\alpha_1$ and the second conical outer surface 625 includes an angle of attack $\alpha_2$. In an exemplary embodiment, the angle of attack $\alpha_1$ is greater than the angle of attack $\alpha_2$. In this manner, the first conical outer surface 620 optimally radially expands the intermediate portions, 206*c*, 214*c*, 220*c*, 300*d*, and 500*c*, of the tubular members, 206, 214, 220, 300, and 500, and the second conical outer surface 525 optimally radially expands the pre-expanded first and second ends, 206*a* and 206*d*, 214*a* and 214*d*, 220*a* and 220*d*, 300*b* and 300*f*, and 500*a* and 500*b*, of the tubular members, 206, 214, 220, 300 and 500. In an exemplary embodiment, the first conical outer surface 620 includes an angle of attack $\alpha_1$ ranging from about 8 to 20 degrees, and the second conical outer surface 625 includes an angle of attack $\alpha_2$ ranging from about 4 to 15 degrees in order to optimally radially expand and plastically deform the tubular members, 206, 214, 220, 300 and 500. More generally, the expansion cone 600 may include 3 or more adjacent conical outer surfaces having angles of attack that decrease from the front end 605 of the expansion cone 600 to the rear end 610 of the expansion cone 600.

Figure 7:
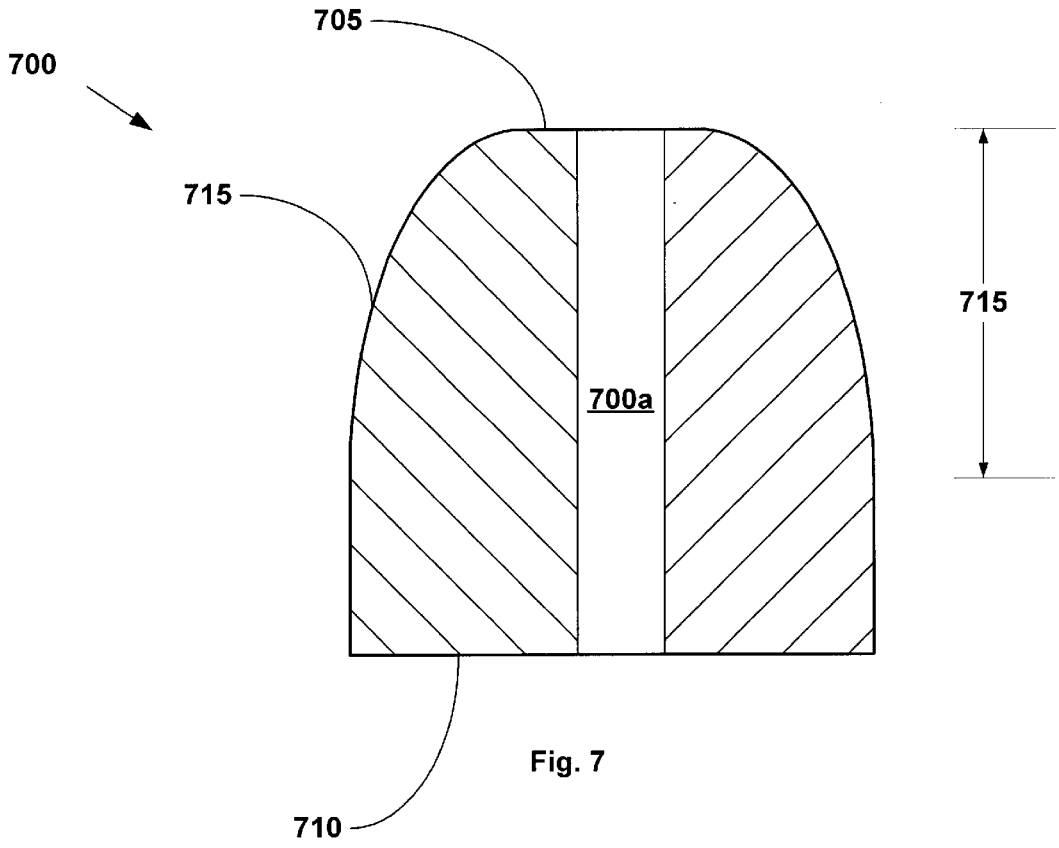
FIG. 7 is a cross-sectional illustration of an exemplary embodiment of a tubular expansion cone.

Referring to FIG. 7, another exemplary embodiment of a tubular expansion cone 700 defines a passage 700*a* and includes a front end 705, a rear end 710, and a radial expansion section 715. In an exemplary embodiment, the radial expansion section 715 includes an outer surface having a substantially parabolic outer profile thereby providing a paraboloid shape. In this manner, the outer surface of the radial expansion section 715 provides an angle of attack that constantly decreases from a maximum at the front end 705 of the expansion cone 700 to a minimum at the rear end 710 of the expansion cone. The parabolic outer profile of the outer surface of the radial expansion section 715 may be formed using a plurality of adjacent discrete conical sections and/or using a continuous curved surface. In this manner, the region of the outer surface of the radial expansion section 715 adjacent to the front end 705 of the expansion cone 700 may optimally radially expand the intermediate portions, 206*c*, 214*c*, 220*c*, 300*d*, and 500*c*, of the tubular members, 206, 214, 220, 300, and 500, while the region of the outer surface of the radial expansion section 715 adjacent to the rear end 710 of the expansion cone 700 may optimally radially expand the pre-expanded first and second ends, 206*a* and 206*d*, 214*a* and 214*d*, 220*a* and 220*d*, 300*b* and 300*f*, and 500*a* and 500*b*, of the tubular members, 206, 214, 220, 300 and 500. In an exemplary embodiment, the parabolic profile of the outer surface of the radial expansion section 715 is selected to provide an angle of attack that ranges from about 8 to 20 degrees in the vicinity of the front end 705 of the expansion cone 700 and an angle of attack in the vicinity of the rear end 710 of the expansion cone 700 from about 4 to 15 degrees.

In an exemplary embodiment, the tubular expansion cone 204 of the system 200 is substantially identical to the expansion cones 600 or 700, and/or incorporates one or more of the teachings of the expansion cones 600 and/or 700.

In several alternative embodiments, the teachings of the apparatus 130, the system 200, the expandable tubular member 300, the method 400, and/or the expandable tubular member 500 are at least partially combined.

An apparatus has been described that includes a zonal isolation assembly including one or more solid tubular members, each solid tubular member including one or more external seals, and one or more perforated tubular members coupled to the solid tubular members, and a shoe coupled to the zonal isolation assembly. In an exemplary embodiment, the zonal isolation assembly further includes one or more intermediate solid tubular members coupled to and interleaved among the perforated tubular members, each intermediate solid tubular member including one or more external seals. In an exemplary embodiment, the zonal isolation assembly further includes one or more valve members for controlling the flow of fluidic materials between the tubular members. In an exemplary embodiment, one or more of the intermediate solid tubular members include one or more valve members.

An apparatus has also been described that includes a zonal isolation assembly that includes one or more primary solid tubulars, each primary solid tubular including one or more external annular seals, n perforated tubulars coupled to the primary solid tubulars, and n−1 intermediate solid tubulars coupled to and interleaved among the perforated tubulars, each intermediate solid tubular including one or more external annular seals, and a shoe coupled to the zonal isolation assembly.

A method of isolating a first subterranean zone from a second subterranean zone in a wellbore has also been described that includes positioning one or more primary solid tubulars within the wellbore, the primary solid tubulars traversing the first subterranean zone, positioning one or more perforated tubulars within the wellbore, the perforated tubulars traversing the second subterranean zone, fluidicly coupling the perforated tubulars and the primary solid tubulars, and preventing the passage of fluids from the first subterranean zone to the second subterranean zone within the wellbore external to the solid and perforated tubulars.

A method of extracting materials from a producing subterranean zone in a wellbore, at least a portion of the wellbore including a casing, has also been described that includes positioning one or more primary solid tubulars within the wellbore, fluidicly coupling the primary solid tubulars with the casing, positioning one or more perforated tubulars within the wellbore, the perforated tubulars traversing the producing subterranean zone, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone. In an exemplary embodiment, the method further includes controllably fluidicly decoupling at least one of the perforated tubulars from at least one other of the perforated tubulars.

An apparatus has also been described that includes a subterranean formation including a wellbore, a zonal isolation assembly at least partially positioned within the wellbore that includes one or more solid tubular members, each solid tubular member including one or more external seals, and one or more perforated tubular members coupled to the solid tubular members, and a shoe positioned within the wellbore coupled to the zonal isolation assembly, wherein at least one of the solid tubular members and the perforated tubular members are formed by a radial expansion process performed within the wellbore. In an exemplary embodiment, the zonal isolation assembly further includes one or more intermediate solid tubular members coupled to and interleaved among the perforated tubular members, each intermediate solid tubular member including one or more external seals, wherein at least one of the solid tubular members, the perforated tubular members, and the intermediate solid tubular members are formed by a radial expansion process performed within the wellbore. In an exemplary embodiment, the zonal isolation assembly further comprises one or more valve members for controlling the flow of fluids between the solid tubular members and the perforated tubular members. In an exemplary embodiment, one or more of the intermediate solid tubular members include one or more valve members for controlling the flow of fluids between the solid tubular members and the perforated tubular members.

An apparatus has also been described that includes a subterranean formation including a wellbore, a zonal isolation assembly positioned within the wellbore that includes one or more primary solid tubulars, each primary solid tubular including one or more external annular seals, n perforated tubulars positioned coupled to the primary solid tubulars, and n−1 intermediate solid tubulars coupled to and interleaved among the perforated tubulars, each intermediate solid tubular including one or more external annular seals, and a shoe coupled to the zonal isolation assembly, wherein at least one of the primary solid tubulars, the perforated tubulars, and the intermediate solid tubulars are formed by a radial expansion process performed within the wellbore.

A method of isolating a first subterranean zone from a second subterranean zone in a wellbore has also been described that includes positioning one or more primary solid tubulars within the wellbore, the primary solid tubulars traversing the first subterranean zone, positioning one or more perforated tubulars within the wellbore, the perforated tubulars traversing the second subterranean zone, radially expanding at least one of the primary solid tubulars and perforated tubulars within the wellbore, fluidicly coupling the perforated tubulars and the primary solid tubulars, and preventing the passage of fluids from the first subterranean zone to the second subterranean zone within the wellbore external to the primary solid tubulars and perforated tubulars.

A method of extracting materials from a producing subterranean zone in a wellbore, at least a portion of the wellbore including a casing, has also been described that includes positioning one or more primary solid tubulars within the wellbore, positioning one or more perforated tubulars within the wellbore, the perforated tubulars traversing the producing subterranean zone, radially expanding at least one of the primary solid tubulars and the perforated tubulars within the wellbore, fluidicly coupling the primary solid tubulars with the casing, fluidicly coupling the perforated tubulars with the primary solid tubulars, fluidicly isolating the producing subterranean zone from at least one other subterranean zone within the wellbore, and fluidicly coupling at least one of the perforated tubulars with the producing subterranean zone. In an exemplary embodiment, the method further includes controllably fluidicly decoupling at least one of the perforated tubulars from at least one other of the perforated tubulars.

An apparatus has also been described that includes a subterranean formation including a wellbore, a zonal isolation assembly positioned within the wellbore that includes n solid tubular members positioned within the wellbore, each solid tubular member including one or more external seals, and n−1 perforated tubular members positioned within the wellbore coupled to and interleaved among the solid tubular members, and a shoe positioned within the wellbore coupled to the zonal isolation assembly. In an exemplary embodiment, the zonal isolation assembly further comprises one or more valve members for controlling the flow of fluids between the solid tubular members and the perforated tubular members. In an exemplary embodiment, one or more of the solid tubular members include one or more valve members for controlling the flow of fluids between the solid tubular members and the perforated tubular members.

A system for isolating a first subterranean zone from a second subterranean zone in a wellbore has also been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for fluidicly coupling the perforated tubulars and the primary solid tubulars, and means for preventing the passage of fluids from the first subterranean zone to the second subterranean zone within the wellbore external to the primary solid tubulars and the perforated tubulars.

A system for extracting materials from a producing subterranean zone in a wellbore, at least a portion of the wellbore including a casing, has also been described that includes means for positioning one or more primary solid tubulars within the wellbore, means for fluidicly coupling the primary solid tubulars with the casing, means for positioning one or more perforated tubulars within the wellbore, the perforated tubulars traversing the producing subterranean zone, means for fluidicly coupling the perforated tubulars with the primary solid tubulars, means for fluidicly isolating the producing subterranean zone from at least one other subterranean zone within the wellbore, and means for fluidicly coupling at least one of the perforated tubulars with the producing subterranean zone. In an exemplary embodiment, the system further includes means for controllably fluidicly decoupling at least one of the perforated tubulars from at least one other of the perforated tubulars.

A system for isolating a first subterranean zone from a second subterranean zone in a wellbore has also been described that includes means for positioning one or more primary solid tubulars within the wellbore, the primary solid tubulars traversing the first subterranean zone, means for positioning one or more perforated tubulars within the wellbore, the perforated tubulars traversing the second subterranean zone, means for radially expanding at least one of the primary solid tubulars and perforated tubulars within the wellbore, means for fluidicly coupling the perforated tubulars and the primary solid tubulars, and means for preventing the passage of fluids from the first subterranean zone to the second subterranean zone within the wellbore external to the primary solid tubulars and perforated tubulars.

A system for extracting materials from a producing subterranean zone in a wellbore, at least a portion of the wellbore including a casing, has also been described that includes means for positioning one or more primary solid tubulars within the wellbore, means for positioning one or more perforated tubulars within the wellbore, the perforated tubulars traversing the producing subterranean zone, means for radially expanding at least one of the primary solid tubulars and the perforated tubulars within the wellbore, means for fluidicly coupling the primary solid tubulars with the casing means for fluidicly coupling the perforated tubulars with the solid tubulars, means for fluidicly isolating the producing subterranean zone from at least one other subterranean zone within the wellbore, and means for fluidicly coupling at least one of the perforated tubulars with the producing subterranean zone. In an exemplary embodiment, the system further includes means for controllably fluidicly decoupling at least one of the perforated tubulars from at least one other of the perforated tubulars.

A system for isolating subterranean zones traversed by a wellbore has also been described that includes a tubular support member defining a first passage, a tubular expansion cone defining a second passage fluidicly coupled to the first passage coupled to an end of the tubular support member and comprising a tapered end, a tubular liner coupled to and supported by the tapered end of the tubular expansion cone, and a shoe defining a valveable passage coupled to an end of the tubular liner, wherein the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the other tubular members are greater than or equal to the outside diameter of the tubular expansion cone. In an exemplary embodiment, the wall thicknesses of the first and second expanded end portions are greater than the wall thickness of the intermediate portion. In an exemplary embodiment, each expandable tubular member further includes a first tubular transitionary member coupled between the first expanded end portion and the intermediate portion, and a second tubular transitionary member coupled between the second expanded end portion and the intermediate portion, wherein the angles of inclination of the first and second tubular transitionary members relative to the intermediate portion ranges from about 0 to 30 degrees. In an exemplary embodiment, the outside diameter of the intermediate portion ranges from about 75 percent to about 98 percent of the outside diameters of the first and second expanded end portions. In an exemplary embodiment, the burst strength of the first and second expanded end portions is substantially equal to the burst strength of the intermediate tubular section. In an exemplary embodiment, the ratio of the inside diameters of the first and second expanded end portions to the interior diameter of the intermediate portion ranges from about 100 to 120 percent. In an exemplary embodiment, the relationship between the wall thicknesses $t_1$, $t_2$, and $t_{INT}$ of the first expanded end portion, the second expanded end portion, and the intermediate portion, respectively, of the expandable tubular members, the inside diameters $D_1$, $D_2$ and $D_{INT}$ of the first expanded end portion, the second expanded end portion, and the intermediate portion, respectively, of the expandable tubular members, and the inside diameter $D_{wellbore}$ of the wellbore casing that the expandable tubular member will be inserted into, and the outside diameter $D_{cone}$ of the expansion cone that will be used to radially expand the expandable tubular member within the wellbore is given by the following expression:

$$Dwellbore - 2 * t_1 \geq D_1 \geq \frac{1}{t_1}[(t_1 - t_{INT}) * D_{cone} + t_{INT} * D_{INT}];$$

wherein $t_1=t_2$; and wherein $D_1=D_2$. In an exemplary embodiment, the tapered end of the tubular expansion cone includes a plurality of adjacent discrete tapered sections. In an exemplary embodiment, the angle of attack of the adjacent discrete tapered sections increases in a continuous manner from one end of the tubular expansion cone to the opposite end of the tubular expansion cone. In an exemplary embodiment, the tapered end of the tubular expansion cone includes an paraboloid body. In an exemplary embodiment, the angle of attack of the outer surface of the paraboloid body increases in a continuous manner from one end of the paraboloid body to the opposite end of the paraboloid body. In an exemplary embodiment, the tubular liner comprises a plurality of expandable tubular members; and wherein the other tubular members are interleaved among the expandable tubular members.

A method of isolating subterranean zones traversed by a wellbore has also been described that includes positioning a tubular liner within the wellbore, and radially expanding one or more discrete portions of the tubular liner into engagement with the wellbore. In an exemplary embodiment, a plurality of discrete portions of the tubular liner are radially expanded into engagement with the wellbore. In an exemplary embodiment, the remaining portions of the tubular liner are not radially expanded. In an exemplary embodiment, one of the discrete portions of the tubular liner is radially expanded by injecting a fluidic material into the tubular liner; and wherein the remaining ones of the discrete portions of the tubular liner are radially expanded by pulling an expansion cone through the remaining ones of the discrete portions of the tubular liner. In an exemplary embodiment, the tubular liner comprises a plurality of tubular members; and wherein one or more of the tubular members are radially expanded into engagement with the wellbore and one or more of the tubular members are not radially expanded into engagement with the wellbore. In an exemplary embodiment, the tubular members that are radially expanded into engagement with the wellbore comprise a portion that is radially expanded into engagement with the wellbore and a portion that is not radially expanded into engagement with the wellbore. In an exemplary embodiment, the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the slotted tubular members are greater than or equal to the maximum inside diameters of the expandable tubular members. In an exemplary embodiment, the tubular liner includes a plurality of expandable tubular members; and wherein the slotted tubular members are interleaved among the expandable tubular members.

A system for isolating subterranean zones traversed by a wellbore has also been described that includes means for positioning a tubular liner within the wellbore, and means for radially expanding one or more discrete portions of the tubular liner into engagement with the wellbore. In an exemplary embodiment, a plurality of discrete portions of the tubular liner are radially expanded into engagement with the wellbore. In an exemplary embodiment, the remaining portions of the tubular liner are not radially expanded. In an exemplary embodiment, one discrete portion of the tubular liner is radially expanded by injecting a fluidic material into the tubular liner; and wherein the other discrete portions of the tubular liner are radially expanded by pulling an expansion cone through the other discrete portions of the tubular liner. In an exemplary embodiment, the tubular liner includes a plurality of tubular members; and wherein one or more of the tubular members are radially expanded into engagement with the wellbore and one or more of the tubular members are not radially expanded into engagement with the wellbore. In an exemplary embodiment, the tubular members that are radially expanded into engagement with the wellbore include a portion that is radially expanded into engagement with the wellbore and a portion that is not radially expanded into engagement with the wellbore.

An apparatus for isolating subterranean zones has also been described that includes a subterranean formation defining a borehole, and a tubular liner positioned in and coupled to the borehole at one or more discrete locations. In an exemplary embodiment, the tubular liner is coupled to the borehole at a plurality of discrete locations. In an exemplary embodiment, the tubular liner is coupled to the borehole by a process that includes positioning the tubular liner within the borehole, and radially expanding one or more discrete portions of the tubular liner into engagement with the borehole. In an exemplary embodiment, a plurality of discrete portions of the tubular liner are radially expanded into engagement with the borehole. In an exemplary embodiment, the remaining portions of the tubular liner are not radially expanded. In an exemplary embodiment, one of the discrete portions of the tubular liner is radially expanded by injecting a fluidic material into the tubular liner; and wherein the other discrete portions of the tubular liner are radially expanded by pulling an expansion cone through the other discrete portions of the tubular liner. In an exemplary embodiment, the tubular liner comprises a plurality of tubular members; and wherein one or more of the tubular members are radially expanded into engagement with the borehole and one or more of the tubular members are not radially expanded into engagement with the borehole. In an exemplary embodiment, the tubular members that are radially expanded into engagement with the borehole include a portion that is radially expanded into engagement with the borehole and a portion that is not radially expanded into engagement with the borehole. In an exemplary embodiment, prior to the radial expansion the tubular liner includes one or more expandable tubular members that each include a tubular body comprising an intermediate portion and first and second expanded end portions coupled to opposing ends of the intermediate portion, and a sealing member coupled to the exterior surface of the intermediate portion, and one or more slotted tubular members coupled to the expandable tubular members, wherein the inside diameters of the slotted tubular members are greater than or equal to the maximum inside diameters of the expandable tubular members. In an exemplary embodiment, the tubular liner includes a plurality of expandable tubular members; and wherein the slotted tubular members are interleaved among the expandable tubular members.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus, comprising:

a zonal isolation assembly comprising:

one or more solid tubular members, each solid tubular member including one or more external seals; and one or more perforated tubular members coupled to the solid tubular members; and a shoe coupled to the zonal isolation assembly.

2. The apparatus of claim 1, wherein the zonal isolation assembly further comprises:

one or more intermediate solid tubular members coupled to and interleaved among the perforated tubular members, each intermediate solid tubular member including one or more external seals.

3. The apparatus of claim 2, wherein one or more of the intermediate solid tubular members include one or more valve members.

4. The apparatus of claim 1, wherein the zonal isolation assembly further comprises one or more valve members for controlling the flow of fluidic materials between the tubular members.

5. An apparatus, comprising:

a zonal isolation assembly comprising:

one or more primary solid tubulars, each primary solid tubular including one or more external annular seals;

n perforated tubulars coupled to the primary solid tubulars; and n−1 intermediate solid tubulars coupled to and interleaved among the perforated tubulars, each intermediate solid tubular including one or more external annular seals; and a shoe coupled to the zonal isolation assembly.

6. A method of isolating a first subterranean zone from a second subterranean zone in a wellbore, comprising:

positioning one or more primary solid tubulars within the wellbore, the primary solid tubulars traversing the first subterranean zone;

positioning one or more perforated tubulars within the wellbore, the perforated tubulars traversing the second subterranean zone;

fluidicly coupling the perforated tubulars and the primary solid tubulars; and preventing the passage of fluids from the first subterranean zone to the second subterranean zone within the wellbore external to the solid and perforated tubulars.

7. A method of extracting materials from a producing subterranean zone in a wellbore, at least a portion of the wellbore including a casing, comprising;

positioning one or more primary solid tubulars within the wellbore;

fluidicly coupling the primary solid tubulars with the casing;

positioning one or more perforated tubulars within the wellbore, the perforated tubulars traversing the producing subterranean zone;

fluidicly coupling the perforated tubulars with the primary solid tubulars;

fluidicly isolating the producing subterranean zone from at least one other subterranean zone within the wellbore; and fluidicly coupling at least one of the perforated tubulars with the producing subterranean zone.

8. The method of claim 7, further comprising:

controllably fluidicly decoupling at least one of the perforated tubulars from at least one other of the perforated tubulars.

9. An apparatus, comprising:

a subterranean formation including a wellbore;

a zonal isolation assembly at least partially positioned within the wellbore comprising:

one or more solid tubular members, each solid tubular member including one or more external seals; and one or more perforated tubular members coupled to the solid tubular members; and a shoe positioned within the wellbore coupled to the zonal isolation assembly;

wherein at least one of the solid tubular members and the perforated tubular members are formed by a radial expansion process performed within the wellbore.

10. The apparatus of claim 9, wherein the zonal isolation assembly further comprises:

one or more intermediate solid tubular members coupled to and interleaved among the perforated tubular members, each intermediate solid tubular member including one or more external seals;

wherein at least one of the solid tubular members, the perforated tubular members, and the intermediate solid tubular members are formed by a radial expansion process performed within the wellbore.

11. The apparatus of claim 10, wherein one or more of the intermediate solid tubular members include one or more valve members for controlling the flow of fluids between the solid tubular members and the perforated tubular members.

12. The apparatus of claim 9, wherein the zonal isolation assembly further comprises one or more valve members for controlling the flow of fluids between the solid tubular members and the perforated tubular members.

13. An apparatus, comprising:

a subterranean formation including a wellbore;

a zonal isolation assembly positioned within the wellbore comprising:

one or more primary solid tubulars, each primary solid tubular including one or more external annular seals;

n perforated tubulars positioned coupled to the primary solid tubulars; and n−1 intermediate solid tubulars coupled to and interleaved among the perforated tubulars, each intermediate solid tubular including one or more external annular seals; and a shoe coupled to the zonal isolation assembly;

wherein at least one of the primary solid tubulars, the perforated tubulars, and the intermediate solid tubulars are formed by a radial expansion process performed within the wellbore.

14. A method of isolating a first subterranean zone from a second subterranean zone in a wellbore, comprising:

positioning one or more primary solid tubulars within the wellbore, the primary solid tubulars traversing the first subterranean zone;

positioning one or more perforated tubulars within the wellbore, the perforated tubulars traversing the second subterranean zone;

radially expanding at least one of the primary solid tubulars and perforated tubulars within the wellbore;

fluidicly coupling the perforated tubulars and the primary solid tubulars; and preventing the passage of fluids from the first subterranean zone to the second subterranean zone within the wellbore external to the primary solid tubulars and perforated tubulars.

15. A method of extracting materials from a producing subterranean zone in a wellbore, at least a portion of the wellbore including a casing, comprising;

positioning one or more primary solid tubulars within the wellbore;

positioning one or more perforated tubulars within the wellbore, the perforated tubulars traversing the producing subterranean zone;

radially expanding at least one of the primary solid tubulars and the perforated tubulars within the wellbore;

fluidicly coupling the primary solid tubulars with the casing;

fluidicly coupling the perforated tubulars with the primary solid tubulars;

fluidicly isolating the producing subterranean zone from at least one other subterranean zone within the wellbore; and fluidicly coupling at least one of the perforated tubulars with the producing subterranean zone.

16. The method of claim 15, further comprising:

controllably fluidicly decoupling at least one of the perforated tubulars from at least one other of the perforated tubulars.

17. An apparatus, comprising:

a subterranean formation including a wellbore;

a zonal isolation assembly positioned within the wellbore comprising:

n solid tubular members positioned within the wellbore, each solid tubular member including one or more external seals; and n−1 perforated tubular members positioned within the wellbore coupled to and interleaved among the solid tubular members; and a shoe positioned within the wellbore coupled to the zonal isolation assembly.

18. The apparatus of claim 17, wherein the zonal isolation assembly further comprises one or more valve members for controlling the flow of fluids between the solid tubular members and the perforated tubular members.

19. The apparatus of claim 17, wherein one or more of the solid tubular members include one or more valve members for controlling the flow of fluids between the solid tubular members and the perforated tubular members.

20. A system for isolating a first subterranean zone from a second subterranean zone in a wellbore, comprising:

means for positioning one or more primary solid tubulars within the wellbore, the primary solid tubulars traversing the first subterranean zone;

means for positioning one or more perforated tubulars within the wellbore, the perforated tubulars traversing the second subterranean zone;

means for fluidicly coupling the perforated tubulars and the primary solid tubulars; and means for preventing the passage of fluids from the first subterranean zone to the second subterranean zone within the wellbore external to the primary solid tubulars and the perforated tubulars.

21. A system for extracting materials from a producing subterranean zone in a wellbore, at least a portion of the wellbore including a casing, comprising;

means for positioning one or more primary solid tubulars within the wellbore;

means for fluidicly coupling the primary solid tubulars with the casing;

means for positioning one or more perforated tubulars within the wellbore, the perforated tubulars traversing the producing subterranean zone;

means for fluidicly coupling the perforated tubulars with the primary solid tubulars;

means for fluidicly isolating the producing subterranean zone from at least one other subterranean zone within the wellbore; and means for fluidicly coupling at least one of the perforated tubulars with the producing subterranean zone.

22. The system of claim 21, further comprising:

means for controllably fluidicly decoupling at least one of the perforated tubulars from at least one other of the perforated tubulars.

23. A system for isolating a first subterranean zone from a second subterranean zone in a wellbore, comprising:

means for positioning one or more primary solid tubulars within the wellbore, the primary solid tubulars traversing the first subterranean zone;

means for positioning one or more perforated tubulars within the wellbore, the perforated tubulars traversing the second subterranean zone;

means for radially expanding at least one of the primary solid tubulars and perforated tubulars within the wellbore;

means for fluidicly coupling the perforated tubulars and the primary solid tubulars; and means for preventing the passage of fluids from the first subterranean zone to the second subterranean zone within the wellbore external to the primary solid tubulars and perforated tubulars.

24. A system for extracting materials from a producing subterranean zone in a wellbore, at least a portion of the wellbore including a casing, comprising;

means for positioning one or more primary solid tubulars within the wellbore;

means for positioning one or more perforated tubulars within the wellbore, the perforated tubulars traversing the producing subterranean zone;

means for radially expanding at least one of the primary solid tubulars and the perforated tubulars within the wellbore;

means for fluidicly coupling the primary solid tubulars with the casing;

means for fluidicly coupling the perforated tubulars with the solid tubulars;

means for fluidicly isolating the producing subterranean zone from at least one other subterranean zone within the wellbore; and means for fluidicly coupling at least one of the perforated tubulars with the producing subterranean zone.

25. The system of claim 24, further comprising:

means for controllably fluidicly decoupling at least one of the perforated tubulars from at least one other of the perforated tubulars.

26. A system for isolating subterranean zones traversed by a wellbore, comprising:

a tubular support member defining a first passage;

a tubular expansion cone defining a second passage fluidicly coupled to the first passage coupled to an end of the tubular support member and comprising a tapered end;

a tubular liner coupled to and supported by the tapered end of the tubular expansion cone; and a shoe defining a valveable passage coupled to an end of the tubular liner;

wherein the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more slotted tubular members coupled to the expandable tubular members;

wherein the inside diameters of the other tubular members are greater than or equal to the outside diameter of the tubular expansion cone.

27. The system of claim 26, wherein the wall thicknesses of the first and second expanded end portions are greater than the wall thickness of the intermediate portion.

28. The system of claim 26, wherein each expandable tubular member further comprises:

a first tubular transitionary member coupled between the first expanded end portion and the intermediate portion; and a second tubular transitionary member coupled between the second expanded end portion and the intermediate portion;

wherein the angles of inclination of the first and second tubular transitionary members relative to the intermediate portion ranges from about 0 to 30 degrees.

29. The system of claim 26, wherein the outside diameter of the intermediate portion ranges from about 75 percent to about 98 percent of the outside diameters of the first and second expanded end portions.

30. The system of claim 26, wherein the burst strength of the first and second expanded end portions is substantially equal to the burst strength of the intermediate tubular section.

31. The system of claim 26, wherein the ratio of the inside diameters of the first and second expanded end portions to the interior diameter of the intermediate portion ranges from about 100 to 120 percent.

32. The system of claim 26, wherein the relationship between the wall thicknesses $t_1$, $t_2$, and $t_{INT}$ of the first expanded end portion, the second expanded end portion, and the intermediate portion, respectively, of the expandable tubular members, the inside diameters $D_1$, $D_2$ and $D_{INT}$ of the first expanded end portion, the second expanded end portion, and the intermediate portion, respectively, of the expandable tubular members, and the inside diameter $D_{wellbore}$ of the wellbore casing that the expandable tubular member will be inserted into, and the outside diameter $D_{cone}$ of the expansion cone that will be used to radially expand the expandable tubular member within the wellbore is given by the following expression:

$$Dwellbore - 2 * t_1 \geq D_1 \geq \frac{1}{t_1}[(t_1 - t_{INT}) * D_{cone} + t_{INT} * D_{INT}];$$

wherein $t_1=t_2$; and wherein $D_1=D_2$.

33. The system of claim 26, wherein the tapered end of the tubular expansion cone comprises:

a plurality of adjacent discrete tapered sections.

34. The system of claim 33, wherein the angle of attack of the adjacent discrete tapered sections increases in a continuous manner from one end of the tubular expansion cone to the opposite end of the tubular expansion cone.

35. The system of claim 26, wherein the tapered end of the tubular expansion cone comprises:

an paraboloid body.

36. The system of claim 35, wherein the angle of attack of the outer surface of the paraboloid body increases in a continuous manner from one end of the paraboloid body to the opposite end of the paraboloid body.

37. The system of claim 26, wherein the tubular liner comprises a plurality of expandable tubular members; and wherein the other tubular members are interleaved among the expandable tubular members.

38. A method of isolating subterranean zones traversed by a wellbore, comprising:

positioning a tubular liner within the wellbore; and radially expanding one or more discrete portions of the tubular liner into engagement with the wellbore;

wherein the tubular liner comprises a plurality of tubular members; and wherein one or more of the tubular members are radially expanded into engagement with the wellbore and one or more of the tubular members are not radially expanded into engagement with the wellbore.

39. The method of claim 38, wherein a plurality of discrete portions of the tubular liner are radially expanded into engagement with the wellbore.

40. The method of claim 38, wherein the remaining portions of the tubular liner are not radially expanded.

41. The method of claim 38, wherein one of the discrete portions of the tubular liner is radially expanded by injecting a fluidic material into the tubular liner; and wherein the remaining ones of the discrete portions of the tubular liner are radially expanded by pulling an expansion cone through the remaining ones of the discrete portions of the tubular liner.

42. The method of claim 38, wherein the tubular members that are radially expanded into engagement with the wellbore comprise a portion that is radially expanded into engagement with the wellbore and a portion that is not radially expanded into engagement with the wellbore.

43. The method of claim 38, wherein the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more slotted tubular members coupled to the expandable tubular members;

wherein the inside diameters of the slotted tubular members are greater than or equal to the maximum inside diameters of the expandable tubular members.

44. The method of claim 43, wherein the tubular liner comprises a plurality of expandable tubular members; and wherein the slotted tubular members are interleaved among the expandable tubular members.

45. A system for isolating subterranean zones traversed by a wellbore, comprising:

means for positioning a tubular liner within the wellbore; and means for radially expanding one or more discrete portions of the tubular liner into engagement with the wellbore;

wherein the tubular liner comprises a plurality of tubular members; and wherein one or more of the tubular members are radially expanded into engagement with the wellbore and one or more of the tubular members are not radially expanded into engagement with the wellbore.

46. The system of claim 45, wherein a plurality of discrete portions of the tubular liner are radially expanded into engagement with the wellbore.

47. The system of claim 45, wherein the remaining portions of the tubular liner are not radially expanded.

48. The system of claim 45, wherein one discrete portion of the tubular liner is radially expanded by injecting a fluidic material into the tubular liner; and wherein the other discrete portions of the tubular liner are radially expanded by pulling an expansion cone through the other discrete portions of the tubular liner.

49. The system of claim 45, wherein the tubular members that are radially expanded into engagement with the wellbore comprise a portion that is radially expanded into engagement with the wellbore and a portion that is not radially expanded into engagement with the wellbore.

50. An apparatus for isolating subterranean zones, comprising:

a subterranean formation defining a borehole; and a tubular liner positioned in and coupled to the borehole at one or more discrete locations;

wherein the tubular liner comprises a plurality of tubular members; and wherein one or more of the tubular members are radially expanded into engagement with the borehole and one or more of the tubular members are not radially expanded into engagement with the borehole.

51. The apparatus of claim 50, wherein the tubular liner is coupled to the borehole at a plurality of discrete locations.

52. The apparatus of claim 50, wherein the tubular liner is coupled to the borehole by a process that comprises:

positioning the tubular liner within the borehole; and radially expanding one or more discrete portions of the tubular liner into engagement with the borehole.

53. The system of claim 52, wherein a plurality of discrete portions of the tubular liner are radially expanded into engagement with the borehole.

54. The system of claim 52, wherein the remaining portions of the tubular liner are not radially expanded.

55. The system of claim 52, wherein one of the discrete portions of the tubular liner is radially expanded by injecting a fluidic material into the tubular liner; and wherein the other discrete portions of the tubular liner are radially expanded by pulling an expansion cone through the other discrete portions of the tubular liner.

56. The system of claim 52, wherein the tubular members that are radially expanded into engagement with the bore hole comprise a portion that is radially expanded into engagement with the borehole and a portion that is not radially expanded into engagement with the borehole.

57. The system of claim 52, wherein prior to the radial expansion the tubular liner comprises:

one or more expandable tubular members that each comprise:

a tubular body comprising an intermediate portion and first and second expanded end portions coupled to opposing ends of the intermediate portion; and a sealing member coupled to the exterior surface of the intermediate portion; and one or more slotted tubular members coupled to the expandable tubular members;

wherein the inside diameters of the slotted tubular members are greater than or equal to the maximum inside diameters of the expandable tubular members.

58. The system of claim 57, wherein the tubular liner comprises a plurality of expandable tubular members; and wherein the slotted tubular members are interleaved among the expandable tubular members.

* * * * *